US011408617B2

(12) United States Patent
Jung et al.

(10) Patent No.: US 11,408,617 B2
(45) Date of Patent: Aug. 9, 2022

(54) AIR CONDITIONER

(71) Applicant: SAMSUNG ELECTRONICS CO., LTD., Suwon-si (KR)

(72) Inventors: Chang-woo Jung, Suwon-si (KR); Sung Jae Kim, Seongnam-si (KR); Yi Goo Gong, Suwon-si (KR); Kwon Jin Kim, Suwon-si (KR); Yeon-seob Yun, Hwaseong-si (KR); Kyeong Ae Lee, Suwon-si (KR); Je Gu Lee, Seoul (KR); Soon Cheol Hong, Pyeongtaek-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 18 days.

(21) Appl. No.: 16/340,829

(22) PCT Filed: Jul. 24, 2017

(86) PCT No.: PCT/KR2017/007942
§ 371 (c)(1),
(2) Date: May 30, 2019

(87) PCT Pub. No.: WO2018/070648
PCT Pub. Date: Apr. 19, 2018

(65) Prior Publication Data

US 2019/0277513 A1 Sep. 12, 2019

(30) Foreign Application Priority Data

Oct. 10, 2016 (KR) ..... 10-2016-0130660

(51) Int. Cl.
*F24F 1/0029* (2019.01)
*F24F 13/10* (2006.01)
(Continued)

(52) U.S. Cl.
CPC ..... *F24F 1/0029* (2013.01); *F24F 1/00* (2013.01); *F24F 1/0014* (2013.01); *F24F 1/028* (2019.02);
(Continued)

(58) Field of Classification Search
CPC ..... F24F 1/0018; F24F 1/0029; F24F 1/028; F24F 13/08; F24F 13/081; F24F 13/082;
(Continued)

(56) References Cited

U.S. PATENT DOCUMENTS 232,166 A * 9/1880 Bales ..... F24F 7/00 454/274
2,600,926 A * 6/1952 Rudd ..... F24F 6/04 454/308
(Continued)

FOREIGN PATENT DOCUMENTS

CN 103363639 10/2013
CN 105180270 12/2015
(Continued)

OTHER PUBLICATIONS

Basic Fundamentals of Gear Drives—Bhatia (2012) (Year: 2012).*
(Continued)

*Primary Examiner* — Jenna M Hopkins
(74) *Attorney, Agent, or Firm* — Staas & Halsey LLP

(57) ABSTRACT

An air conditioner includes a heat exchanger for exchanging heat with air brought into a housing, and a blower fan for blowing air that has exchanged heat with the heat exchanger out of the housing, and controls a guide unit that opens or closes part of an outlet provided in the housing to blow out various flows of air.

20 Claims, 15 Drawing Sheets

(51) Int. Cl.

| | |
|---|---|
| ***F24F 13/20*** | (2006.01) |
| ***F24F 11/00*** | (2018.01) |
| ***F24F 1/00*** | (2019.01) |
| ***F24F 13/08*** | (2006.01) |
| ***F24F 1/028*** | (2019.01) |
| ***F24F 13/16*** | (2006.01) |
| ***F24F 13/065*** | (2006.01) |
| ***F24F 13/12*** | (2006.01) |
| ***F24F 1/0014*** | (2019.01) |
| ***F24F 11/74*** | (2018.01) |
| ***F24F 1/0018*** | (2019.01) |
| ***F24F 11/30*** | (2018.01) |
| ***F24F 11/755*** | (2018.01) |

(52) U.S. Cl.

CPC ..... *F24F 11/00* (2013.01); *F24F 11/74* (2018.01); *F24F 13/065* (2013.01); *F24F 13/08* (2013.01); *F24F 13/081* (2013.01); *F24F 13/082* (2013.01); *F24F 13/10* (2013.01); *F24F 13/12* (2013.01); *F24F 13/16* (2013.01); *F24F 13/20* (2013.01); *F24F 1/0018* (2013.01); *F24F 11/30* (2018.01); *F24F 11/755* (2018.01); *F24F 2013/205* (2013.01)

(58) Field of Classification Search

CPC .. F24F 7/013; F24F 13/10; F24F 13/18; F24F 13/12; F24F 2013/205; F24F 11/74; F24F 11/30; F24F 11/32–49; F24F 11/70; F24F 11/755; F24F 1/0007; F24F 1/0014; F24F 1/0033; F24F 1/0284; F24F 1/02; F24F 13/065; F24F 13/16; F24F 13/20

See application file for complete search history.

(56) References Cited

U.S. PATENT DOCUMENTS

| | | | | | |
|---|---|---|---|---|---|
| 3,068,891 | A * | 12/1962 | Panning | F24F 13/105 | 137/499 |
| 4,796,803 | A * | 1/1989 | Kelley | G05D 23/023 | 137/625.33 |
| 5,120,274 | A * | 6/1992 | Zeller | F24F 13/12 | 454/298 |
| 5,128,998 | A * | 7/1992 | Kurihara | H03K 3/84 | 708/250 |
| 5,433,661 | A * | 7/1995 | Kim | F24F 1/02 | 454/285 |
| 5,461,875 | A * | 10/1995 | Lee | F24F 11/00 | 62/89 |
| 5,746,655 | A * | 5/1998 | Lee | F24F 13/06 | 454/233 |
| 5,807,170 | A * | 9/1998 | Lee | F24F 1/0007 | 454/233 |
| 6,019,155 | A * | 2/2000 | Daoud | E04H 15/38 | 160/127 |
| 6,807,772 | B2 * | 10/2004 | Halter | E06B 9/26 | 49/38 |
| 7,431,638 | B2 * | 10/2008 | Natsume | B60H 1/00692 | 137/614.11 |
| 8,037,707 | B2 * | 10/2011 | Lee | F24F 1/022 | 62/285 |
| 8,371,913 | B1 * | 2/2013 | Taylor | F24F 7/013 | 454/210 |
| 8,535,126 | B2 * | 9/2013 | Fincher | F24F 11/74 | 454/258 |
| 9,021,829 | B2 * | 5/2015 | Jung | F24F 13/12 | 62/409 |
| 9,255,722 | B2 * | 2/2016 | Kim | F24F 13/20 | |
| 9,664,407 | B2 * | 5/2017 | Sakoda | F04D 29/666 | |
| 9,759,445 | B2 * | 9/2017 | Kim | F24F 1/005 | |
| 9,932,990 | B2 * | 4/2018 | Schone | F04D 29/541 | |
| 9,933,168 | B2 * | 4/2018 | Sun | F24F 1/0029 | |
| 10,365,006 | B2 * | 7/2019 | McQueeny, Jr | F24F 13/06 | |
| 10,473,339 | B2 * | 11/2019 | Song | F24F 1/005 | |
| 10,578,319 | B2 * | 3/2020 | Shin | F24F 1/005 | |
| 10,591,170 | B2 * | 3/2020 | Lee | F24F 13/082 | |
| 10,684,024 | B2 * | 6/2020 | Lee | F24F 1/0029 | |
| 2002/0084058 | A1 * | 7/2002 | Ozeki | B60H 1/00692 | 165/42 |
| 2006/0037355 | A1 * | 2/2006 | Hwang | F24F 1/0014 | 62/428 |
| 2007/0129001 | A1 * | 6/2007 | Orr | F24F 11/0001 | 454/239 |
| 2007/0190927 | A1 * | 8/2007 | Bash | F24F 13/105 | 454/327 |
| 2012/0055186 | A1 * | 3/2012 | Jung | F24F 13/1486 | 62/259.1 |
| 2012/0190293 | A1 * | 7/2012 | Badenhorst | F24F 13/065 | 454/284 |
| 2016/0033151 | A1 * | 2/2016 | Jacobs | F24F 13/20 | 454/208 |
| 2016/0131369 | A1 * | 5/2016 | Jung | F24F 1/0007 | 165/122 |
| 2017/0016633 | A1 * | 1/2017 | Jeon | F24F 1/0033 | |
| 2017/0016634 | A1 * | 1/2017 | Lee | F24F 13/10 | |
| 2017/0023264 | A1 * | 1/2017 | Ha | F24F 1/005 | |
| 2018/0209687 | A1 * | 7/2018 | Chun | F24F 13/06 | |
| 2018/0274798 | A1 * | 9/2018 | Jung | F24F 1/022 | |
| 2018/0328605 | A1 * | 11/2018 | Bae | B01D 46/42 | |
| 2018/0335221 | A1 * | 11/2018 | Cho | F24F 1/0022 | |
| 2019/0003727 | A1 * | 1/2019 | Kim | F24F 13/08 | |
| 2019/0186778 | A1 * | 6/2019 | Cho | F25B 30/02 | |
| 2019/0219278 | A1 * | 7/2019 | Lee | F24F 1/005 | |
| 2019/0277513 | A1 * | 9/2019 | Jung | F24F 1/0018 | |
| 2020/0232655 | A1 * | 7/2020 | Jeong | F24F 13/08 | |

FOREIGN PATENT DOCUMENTS

| | | | | | |
|---|---|---|---|---|---|
| DE | 102007031421 | A1 * | 1/2009 | F24F 1/0047 | |
| GB | 1436838 | A * | 5/1976 | B60H 1/3442 | |
| KR | 10-0277987 | | 1/2001 | | |
| KR | 10-0779538 | | 11/2007 | | |
| KR | 20110029870 | A * | 3/2011 | | |
| KR | 10-2014-0048363 | | 4/2014 | | |
| KR | 10-2015-0082969 | | 7/2015 | | |
| KR | 10-2016-0051095 | | 5/2016 | | |
| KR | 20160051095 | A * | 5/2016 | | |
| WO | WO-2011109870 | A1 * | 9/2011 | F24F 13/10 | |
| WO | WO-2016030032 | A1 * | 3/2016 | F24F 13/20 | |
| WO | WO-2017073896 | A1 * | 5/2017 | F24F 1/00 | |

OTHER PUBLICATIONS

KR 20110029870 A English Machine Translation (Year: 2011).*

KR20160051095A English Machine Translation (Year: 2016).*

International Search Report dated Nov. 8, 2017 from International Patent Application No. PCT/KR2017/007942, 5 pages.

Written Opinion of the International Searching Authority dated Nov. 8, 2017 from International Patent Application No. PCT/KR2017/007942, 7 pages.

Chinese Office Action dated Jul. 10, 2020 from Chinese Application No. 201780062576.2, 18 pages.

Chinese Office Action dated Mar. 25, 2021 from Chinese Application No. 201780062576.2, 20 pages.

Chinese Office Action dated Sep. 2, 2021 from Chinese Application No. 201780062576.2.

* cited by examiner

AIR CONDITIONER

CROSS-REFERENCE TO RELATED APPLICATIONS

This application is a U.S. National Stage Application which claims the benefit under 35 U.S.C. § 371 of International Patent Application No. PCT/KR2017/007942 filed on Jul. 24, 2017, which claims foreign priority benefit under 35 U.S.C. § 119 of Korean Patent Application No. 10-2016-0130660 filed on Oct. 10, 2016 in the Korean Intellectual Property Office, the contents of both of which are incorporated herein by reference.

TECHNICAL FIELD

The disclosure relates to air conditioners, and more particularly, to an air conditioner employing different air discharging methods to control the flow of discharged air.

BACKGROUND ART

In general, an air conditioner is a device for controlling temperature, humidity, airflows, airflow distribution, etc., to be right for human activities and simultaneously, eliminating dust or something in the air by using refrigeration cycles. The refrigeration cycle is comprised of key elements, such as a compressor, a condenser, an evaporator, a blower fan, etc.

The air conditioners may be classified into split air conditioners with indoor and outdoor units separately installed, and packaged air conditioners with indoor and outdoor units installed together in a single cabinet. The indoor unit of the split air conditioner includes a heat exchanger for exchanging heat of the air sucked into the panel, and a blower fan for sucking the room air into the panel and blowing the air back into the room.

The indoor units of conventional air conditioners are manufactured such that the heat exchanger is minimized in size and the air velocity and air volume are maximized by increasing revolutions per minute (rpm) of the blower fan. This reduces discharge temperature, and discharges the air into the room through a narrow and long fluid path.

When the user is directly exposed to the discharged air, he/she might feel cold and unpleasant, and on the contrary, when he/she is not exposed to the discharged air, he/she might feel hot and unpleasant.

Furthermore, increasing the rotation speed of the blower fan to achieve high wind velocity may lead to an increase of noise. A radiation air conditioner that conditions air without the blower fan requires a large panel to have an equal capability of an air conditioner that uses the blower fan. This may slow down the cooling speed and increase installation costs.

DISCLOSURE

Technical Problem

The disclosure provides an air conditioner capable of variously controlling discharged airflow.

The disclosure also provides an air conditioner employing different air discharging methods.

The disclosure also provides an air conditioner capable of cooling or heating rooms at a minimum wind velocity at which the user may feel pleasant.

Technical Solution

In accordance with an aspect of the disclosure, an air conditioner includes a housing having an outlet; a heat exchanger arranged inside the housing; a guide unit configured to control airflow discharged through the outlet by selectively opening or closing part of the outlet by rotation; and a blower fan having a rotation shaft arranged to be parallel to a rotation shaft of the guide unit and sucking air into the housing to move the air toward the outlet.

The guide unit may include a first guide covering part of the outlet and a second guide covering the other part of the outlet, the second guide may open the other part of the outlet while overlapping the first guide by being rotated in a first direction, and when the other part of the outlet is opened, the second guide may close the other part of the outlet by being rotated in a second direction.

When the second guide is rotated in the first direction to fully overlap the first guide or in the second direction to fully close the outlet, the first and second guides may be rotated together in the first or second direction.

The air conditioner may further include a motor provided to rotate the second guide in the first or second direction.

The air conditioner may further include a first gear coupled to the second guide, and a second gear coupled to the motor, and the second guide may be coupled to the motor by the first and second gears.

The first gear may be formed as an internal gear, and the motor may be arranged to have a driving shaft arranged in parallel with a rotation shaft of the second guide.

The first gear may be formed as a crown gear, and the motor may be arranged to have a driving shaft line cross a rotation shaft line of the second guide.

The first gear may be coupled to a rotation shaft of the second guide, and the motor may be arranged in a center part of the second guide.

The first gear may be coupled to an edge of the second guide, and the motor may be arranged near the edge of the second guide.

The guide unit may include a first guide covering part of the outlet and a second guide covering the other part of the outlet, the air conditioner may further include a first motor configured to rotate the first guide and a second motor configured to rotate the second guide, and part of the outlet may be selectively opened while the first and second guides overlap each other by rotation of at least one of the first and second guides.

The outlet may have a circular form, and the guide unit may have a domed form.

The housing may include a main housing body and a bottom cover capable of being opened downward.

The housing may include an inlet provided on a rear side, and a leg provided for the inlet to be separated from an installation plane.

The air conditioner may further include a sensor configured to set up and control a reference position for the guide unit.

The guide unit may include a plurality of holes for discharging air from inside the housing when the outlet is closed.

In accordance with another aspect of the disclosure, an air conditioner includes a housing having an outlet; a heat exchanger arranged inside the housing; a blower fan configured to suck air into the housing and move air toward the outlet; and a guide unit configured to open or close part of the outlet by being rotated, control airflow discharged through the outlet by changing a position of an opened part of the outlet, and include a plurality of holes for discharging air from inside the housing when the outlet is closed.

The outlet may have a circular form, the guide unit may include a plurality of guides shaped like arcs covering the outlet, and the plurality of guides may open part of the outlet while overlapping each other by rotation.

In accordance with another aspect of the disclosure, an air conditioner includes a housing including an outlet and a plurality of holes formed around the outlet to discharge air; a heat exchanger arranged inside the housing; a blower fan configured to suck air into the housing and move air toward the outlet; and a guide unit configured to control airflow discharged through the outlet by selectively opening or closing part of the outlet.

The housing may include a plurality of outlets, and the blower fan and the guide unit may be each provided in the plural to correspond to the plurality of outlets.

The guide unit may include a plurality of guides configured to open part of the outlet while overlapping each other by rotation.

Advantageous Effects

According to the disclosure, an air conditioner may blow air while varying the flow of heat-exchanged air depending on user environments.

The air conditioner may also discharge the heat-exchanged air at different wind velocities.

Furthermore, the air conditioner may cool or heat rooms not to expose the user directly to the heat exchanged air, thereby increasing user satisfaction.

MODE FOR INVENTION

Figure 1:
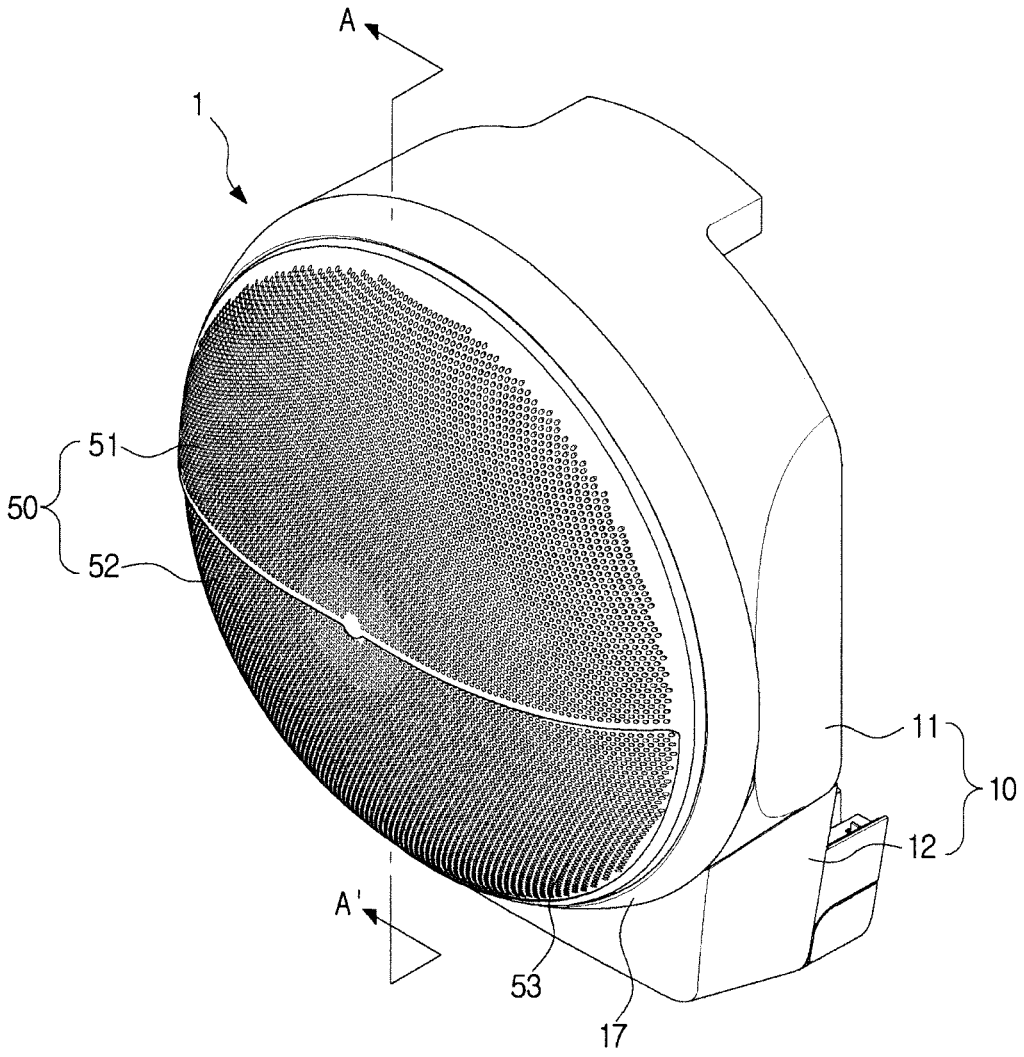
FIG. 1 is a perspective view of an air conditioner, according to an embodiment of the disclosure.

Embodiments and features as described and illustrated in the disclosure are only preferred examples, and various modifications thereof may also fall within the scope of the disclosure.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "include", "comprise" and/or "have" when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or section discussed below could be termed a second element, component, region, layer or section without departing from the teachings of the disclosure. Descriptions shall be understood as to include any and all combinations of one or more of the associated listed items when the items are described by using the conjunctive term "~ and/or ~," or the like.

The terms "front", "rear", "upper", "lower", "top", and "bottom" as herein used are defined with respect to the drawings, but the terms may not restrict the shape and position of the respective components.

Reference will now be made in detail to embodiments, examples of which are illustrated in the accompanying drawings, wherein like reference numerals refer to the like elements throughout.

A refrigeration cycle of an Air conditioner (AC) is comprised of a compressor, a condenser, an expansion valve, and an evaporator. Refrigerants go through a series of processes of compression, condensing, expansion, and evaporation, enabling high temperature air to exchange heat with low temperature refrigerants and then the low temperature air to be supplied into the room.

A compressor compresses a gas refrigerant into a high temperature and high pressure state and discharges the compressed gas refrigerant, and the discharged gas refrigerant flows into a condenser. The condenser condenses the compressed gas refrigerant into a liquid state, releasing heat to the surroundings. An expansion valve expands the high temperature and high pressure liquid refrigerant condensed by the condenser to low pressure liquid refrigerant. The evaporator evaporates the refrigerant expanded by the expansion valve. The evaporator achieves a cooling effect using latent heat of vaporization of the refrigerant to exchange heat with an object to be cooled, and has low temperature and low pressure gas refrigerant return to the compressor. Through this cycle, the temperature of indoor air may be conditioned.

An outdoor unit of an air conditioner refers to a part comprised of the compressor and an outdoor heat exchanger of the refrigeration cycle. The expansion valve may be placed in one of the indoor or outdoor units, and the indoor heat exchanger is placed in the indoor unit of the air conditioner.

The disclosure is directed to an air conditioner for cooling indoor space, where the outdoor heat exchanger serves as the condenser while the indoor heat exchanger serves as the evaporator. Hereinafter, for convenience of explanation, an indoor unit including the indoor heat exchanger is called an air conditioner, and the indoor heat exchanger is called a heat exchanger.

Figure 2:
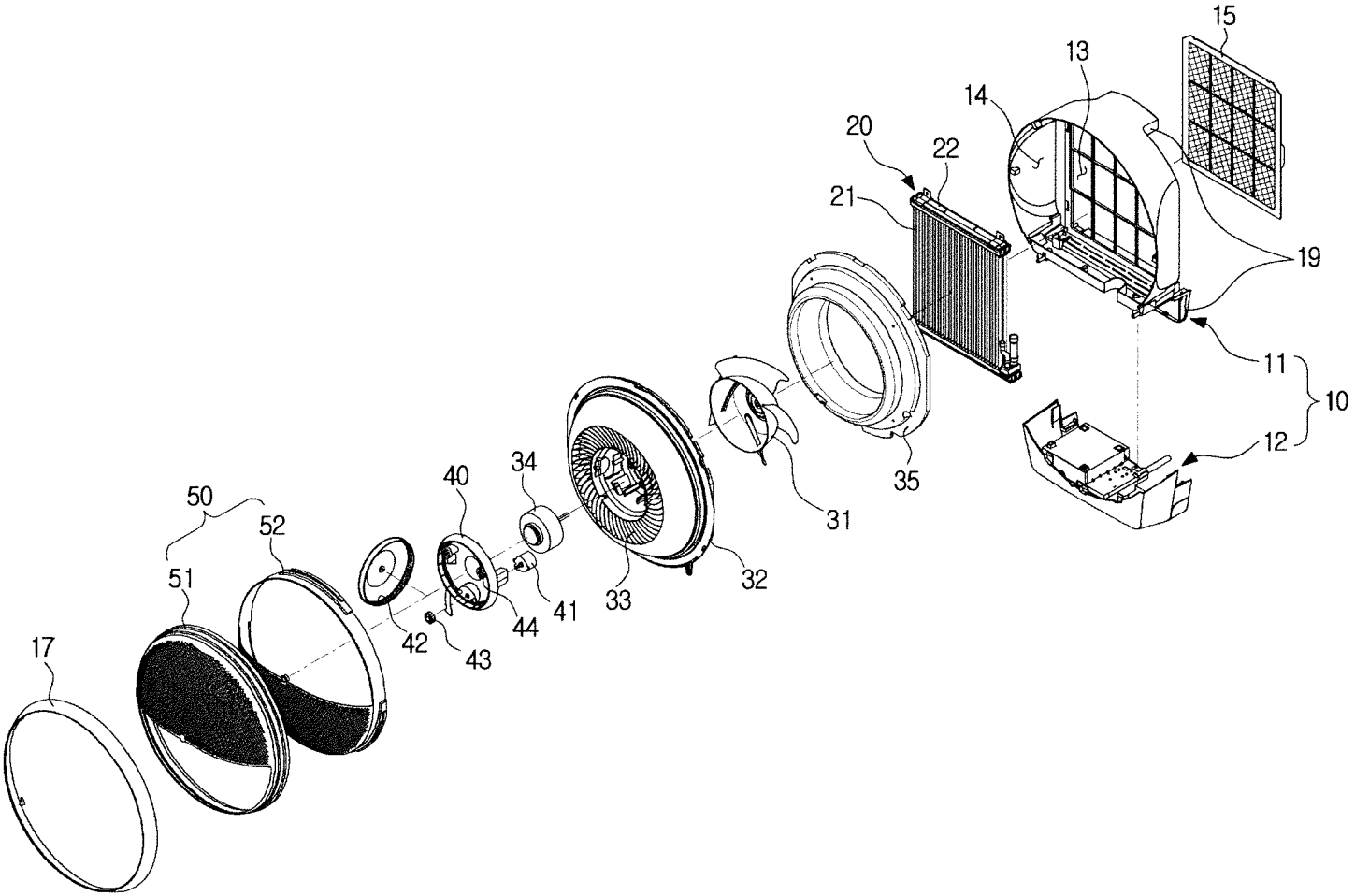
FIG. 2 is an exploded view of an air conditioner, according to an embodiment of the disclosure.
Figure 3:
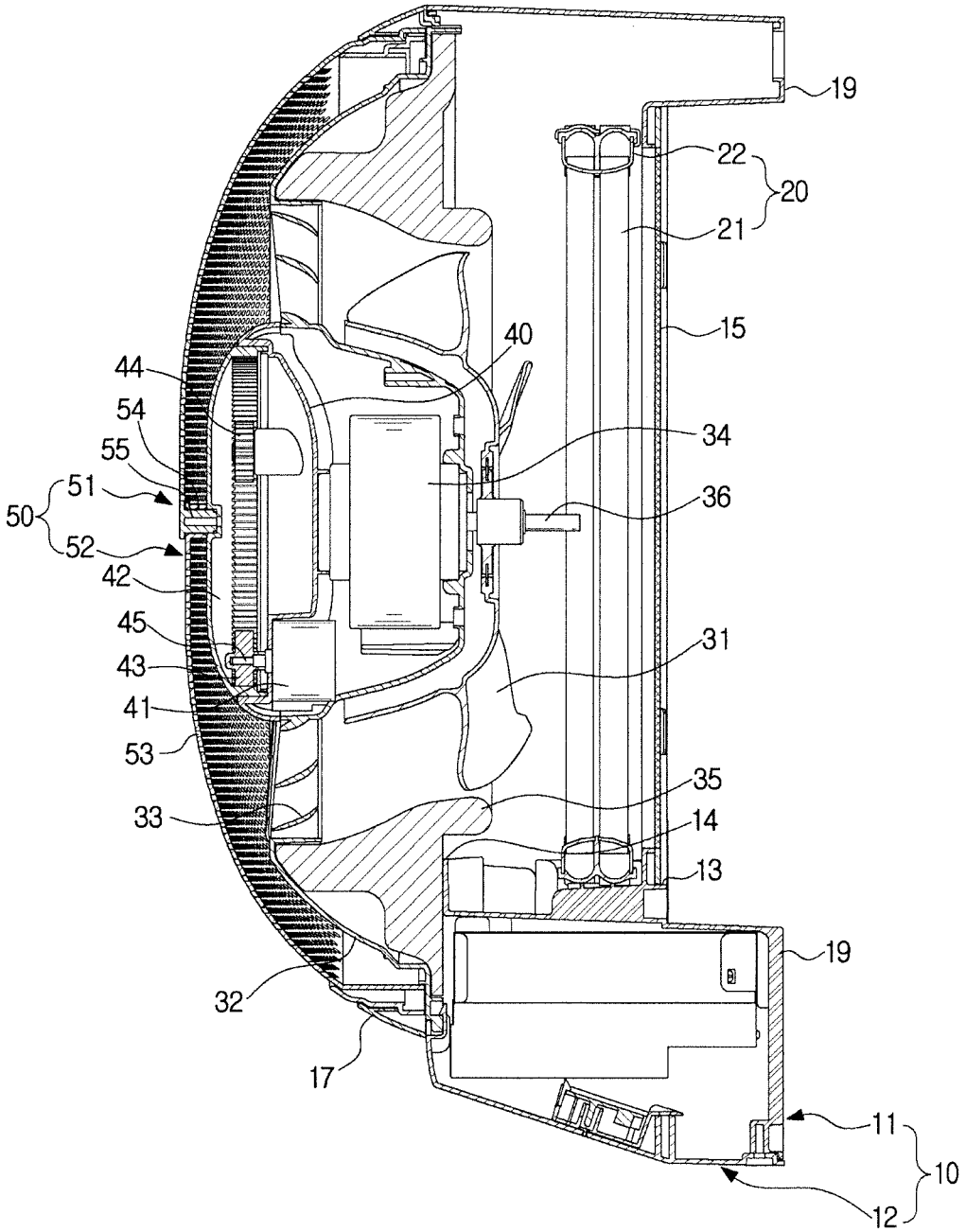
FIG. 3 is a cross-sectional view of A-A' of FIG. 1.

FIG. 1 is a perspective view of an air conditioner, according to an embodiment of the disclosure, FIG. 2 is an exploded view of an air conditioner, according to an embodiment of the disclosure, and FIG. 3 is a cross-sectional view of A-A' of FIG. 1.

An air conditioner 1 may include a housing 10 having an inlet 13 and an outlet 14, a heat exchanger 20 arranged inside the housing 10 for exchanging heat with air moved into the housing 10, and a blower fan 31 for sucking air into the housing 10 and circulating the air toward the outlet 14.

The outlet 14 may have a circular form, and the housing 10 may include a main housing body 11 that has almost a circular form to match the form of the outlet 14, and a bottom cover 12 that may be opened downward.

The air conditioner 1 may be arranged to be fixed to the wall. Specifically, the main housing body 11 may be arranged to be fixed to the wall. The main housing body 11 may include legs 19 arranged for the inlet 13, which is located on the rear side of the main housing body 11, to be separated from the wall, such that air may be sucked in through the inlet 13 while the air conditioner 1 is fixed to the wall.

The bottom cover 12 may be provided to be opened or closed vertically after the main housing body 11 is fixed to the wall, making it easy to connect pipes or power lines in the installation process of the air conditioner 1.

The air conditioner 1 may include a guide unit 50 to open or close the outlet 14. Furthermore, the air conditioner 1 may include a ring-shaped finishing member 17 for decoration of the edges of the guide unit 50. Specifically, the guide unit 50 may be arranged on the front of the housing 10 to selectively open or close a portion of the outlet 14 by rotation. As the guide unit 50 selectively opens or closes a portion of the outlet 14, it may control airflow such as the direction or air volume of air discharged through the outlet 14. Furthermore, the guide unit 50 may include a plurality of holes 53 to discharge air from inside the housing 10 when the outlet 14 is closed.

Since the air conditioner 1 according to the embodiment as shown in FIGS. 1 to 3 has no extra front panel with an outlet on the front of the housing 10, the guide unit 50 to open or close the outlet 14 may be considered part of the housing 10 that constitutes the exterior of the air conditioner 1. The shape of the housing is not, however, limited thereto, and the housing may have any of different shapes, such as a rectangular shape having a front cover with a circular outlet.

The guide unit 50 may include a plurality of guides shaped like arcs, which cover the circular outlet 14. Specifically, the guide unit 50 may be shaped like a dome, including a first guide 51 covering a portion of the outlet 14 and a second guide 52 covering the other portion of the outlet 14. A portion of the outlet 14 may be opened by rotation of at least one of the first and second guides 51 and 52.

The first and second guides 51 and 52 may include rounded edges to match the circular outlet, and include cover parts 56 that cover portions of the outlet 14 and openings 57 that may open portions of the outlet 14. The cover parts 56 may include the plurality of holes 53 to discharge air from inside the housing 10 when the guide unit 50 closes the outlet 14.

Although not shown, the guide unit may be provided to include a plurality of guides formed in other various shapes that are rotational, besides the dome shape.

The blower fan 31 may be an axial-flow fan or a mixed-flow fan. The blower fan 31 may be arranged for a rotation shaft 36 to be perpendicular to the outlet 14 in order to circulate air directly toward the outlet 14. Specifically, the blower fan 31 may be arranged for the rotation shaft 36 to be in parallel with rotation shafts 54 and 55 of the guide unit 50 that covers the outlet 14.

The air conditioner 1 may include a blower grill 32 arranged in front of the blower fan 31. The blower grill 32 may be arranged in a discharging direction of the blower fan 31 to guide the flow of air. Furthermore, the blower grill 32 may be arranged between the blower fan 31 and the outlet 14 for minimizing the influence of outside conditions of the housing 10 on the blower fan 31.

The blower grill 32 may include a plurality of wings 33. The plurality of wings 33 may control the direction or the volume of the air blown from the blower fan 31 to the outlet 14 by controlling the number, shape, and/or position angle of the wings 33.

The blower grill 32 may be provided for a guide driver 40 and a fan motor 34 to be arranged at the center of the blower grill 32. The guide driver 40 and the fan motor 34 may be arranged to be in tandem in the same line. With this structure, the plurality of wings 33 of the blower grill 32 may be arranged in front of the fan wings of the blower fan 31.

The air conditioner 1 may include a bell mouth 35 formed to have a circular shape that encloses the blower fan 31 to guide the flow of air flowing to the blower fan 31. In other words, the bell mouth 35 guides the air sucked in through the inlet 13 and moved into the housing 10 to flow to the blower fan 31.

The blower fan 31 may be arranged in front of the inlet 13 placed on the rear side of the main housing body 11, and the heat exchanger 20 may be arranged between the blower fan 31 and the inlet 13. The heat exchanger 20 may absorb heat from the air brought in through the inlet 13 or transfer heat to the air brought in through the inlet 13. The heat exchanger 20 may include a tube 21, and headers 22 combined with the tube 21 at the upper and bottom sides of the tube 21. However, the type of the heat exchanger 20 is not limited thereto.

Although not shown, the heat exchanger 20 may be arranged between the blower fan 31 and the outlet 14. When the heat exchanger 20 is arranged before the blower fan 31, it may help the air discharged through the outlet 14 have a uniform distribution of temperature.

A filter 15 may be attached to the outer side of the inlet 13 of the housing 10. The filter 15 may filter out foreign materials such as dust contained in the outside air sucked in through the inlet 13. Furthermore, although not shown, the air conditioner 1 may further include an extra filter arranged inside the housing 10 to adsorb and filter out foreign materials such as dust and scent molecules contained in the air.

The guide driver 40 may include a motor 41 provided to rotationally drive at least one of the first and second guides 51 and 52. The guide driver 40 may also include a first gear 42 coupled to at least one of the first and second guides 51 and 52, and a second gear 43 coupled to the motor 41. At least one of the first and second guides 51 and 52 may be coupled to the motor 41 by the first and second gears 42 and 43.

Figure 4:
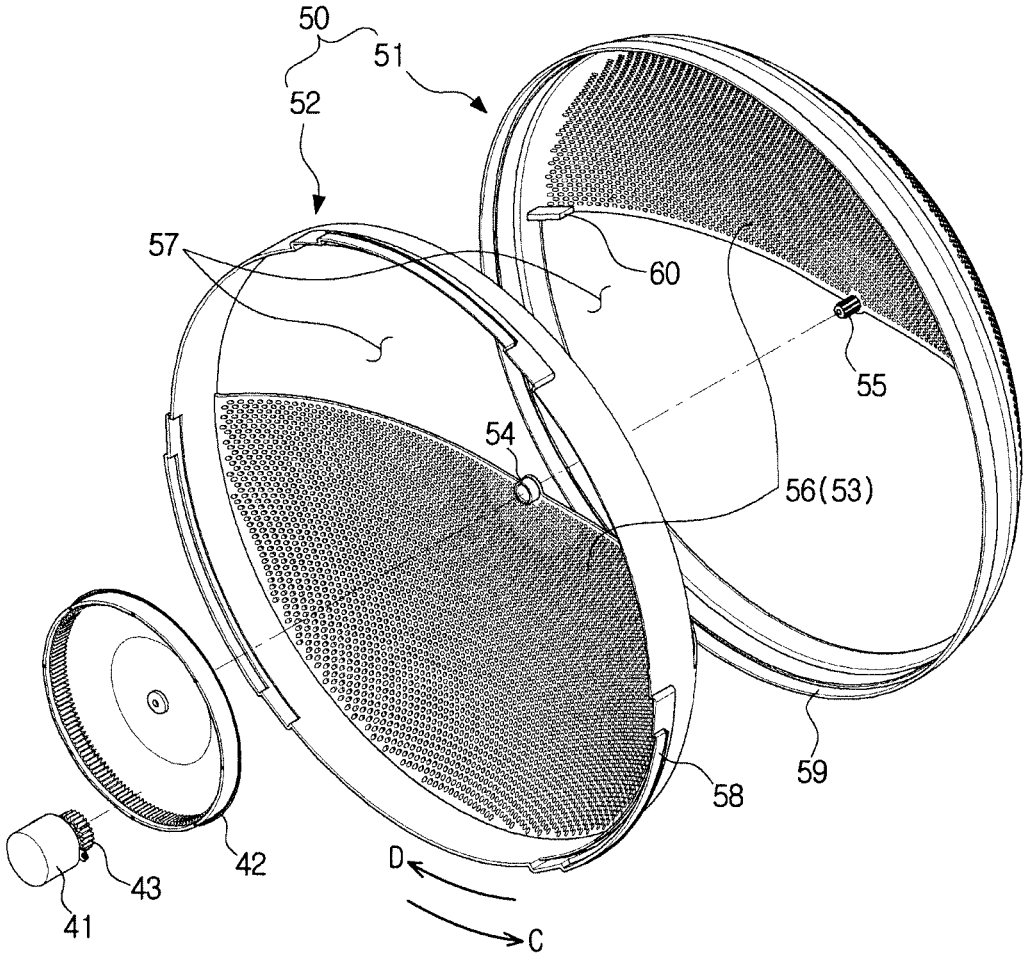
FIG. 4 is an exploded view of an air conditioner whose guide unit and motor are viewed from behind, according to an embodiment of the disclosure.

FIG. 4 is an exploded view of an air conditioner whose guide unit and motor are viewed from behind, according to an embodiment of the disclosure.

Referring to FIGS. 3 and 4, the guide unit 50 of the air conditioner 1 according to an embodiment may have the second guide 52 rotated by the motor 41 in a first direction C or second direction D. Specifically, the first gear 42 is coupled to the rotation shaft 54 of the second guide 52 and the second gear 43 is coupled to a driving shaft 45 of the motor 41, so the second guide 52 may be rotated by the motor 41.

The first gear 42 may be formed to be an internal gear that has teeth arranged on the inner side of the gear and being in gear with the second gear 43 inside the gear. In the case that the first gear 42 is formed as the internal gear, the motor 41 may be arranged for the driving shaft 45 to be parallel to the rotation shaft 54 of the second guide 52, and the first and second gears 42 and 43 rotates in the same direction.

Apart from the second gear 43 coupled to the motor 41, the guide driver 40 may include an additional supporting gear 44 for stable rotation of the first gear 42. The supporting gear 44 may help the first gear 42 stably rotated in gear with the second gear 43.

The first and second gears 42 and 43 may make the motor 41 of the guide driver 40 and the fan motor 34 for driving the blower fan 31 arranged back and forth not in the same straight line but obliquely. Accordingly, even when the guide driver 40 is arranged at the center of the guide unit 50 so that the guide driver 40 and the fan motor 34 are arranged in tandem in the same line, the motor 41 at the center of the guide unit 50 and the fan motor 34 are arranged obliquely, thereby allowing the air conditioner 1 to be slimmed down.

The first and second guides 51 and 52 may be combined for the rotation shaft 55 of the first guide 51 to pass the rotation shaft 54 of the second guide 52, which is the cavity shaft. Furthermore, a guide projection 58 may be formed along the edges of the second guide 52 to be rotated in gear with the first guide 51, and a guide rail 59 may be formed along the edges of the first guide 51 to receive the guide projection 58 of the second guide 52.

The guide unit 50 may include a stopper 60 arranged for the second guide 52 to push and rotate with the first guide 51. The stopper 60 may be formed on the rear side of the first guide 51 to protrude toward the second guide 52. When the second guide 52 is rotated by the motor 41 in the first direction C and fully overlaps the first guide 51 or in the second direction D to completely close the outlet 14, the first and second guides 51 and 52 may be rotated together in the first direction C or the second direction D.

Figure 5:
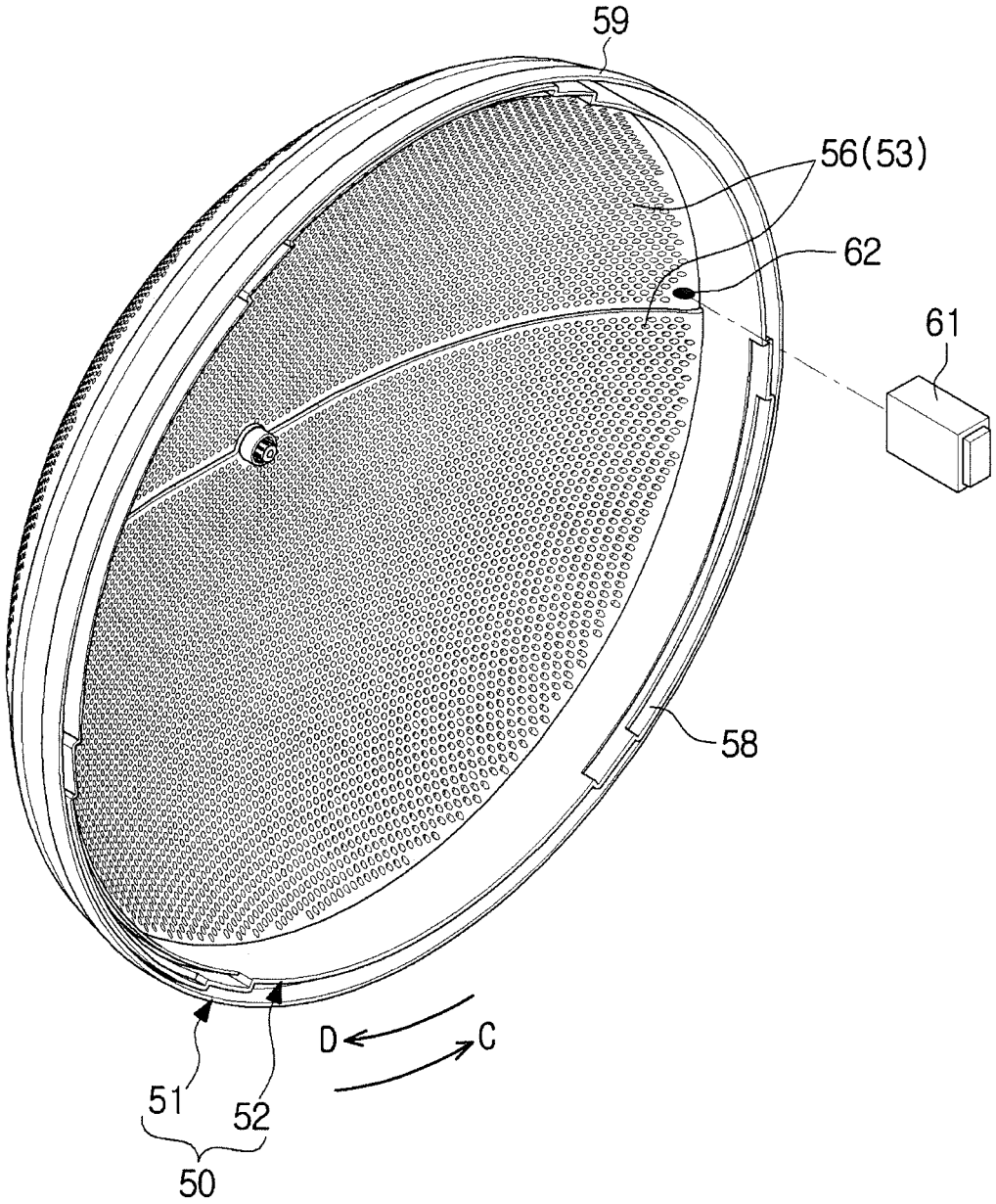
FIG. 5 is an exploded view of an air conditioner whose guide unit and sensor are viewed from behind, according to an embodiment of the disclosure.

FIG. 5 is an exploded view of an air conditioner whose guide unit and sensor are viewed from behind, according to an embodiment of the disclosure.

The air conditioner 1 may include a sensor 61 that sets up and controls a reference position for the first and second guides 51 and 52 to return to the reference position after the second guide 52 of the guide unit 50 is rotated in the second direction D and completely closes the outlet 14.

The first guide 51 may include a sensing part 62 that is hidden when the second guide 52 is rotated in the first direction C and exposed when the second guide 52 is rotated in the second direction D and completely closes the outlet 14. The sensing part 62 may be formed on the rear side of the first guide 51, and the sensor 61 may be arranged to detect the sensing part 62 when the first guide 51 is at the reference position. The sensing part 62 may be formed of e.g., a magnet, and the sensor 61 may be formed with e.g., a hall sensor.

In an embodiment of the disclosure, the guide unit 50 of the air conditioner 1 may open or close the outlet 14 as well as variously set up and control the airflow, such as direction or volume of the air.

The conventional air conditioner has controlled the horizontal and vertical directions with respective motors, in order to control the flow of discharged air. The air conditioner 1 according to the disclosure, however, may use the single motor 41 for the guide driver 40 that drives the guide unit 50 to open or close the outlet 14 and form different flows of discharged air.

Furthermore, the conventional air conditioner that opens or closes the outlet in a forward and backward driving method has required a body tube structure that is able to drive an outlet open/close door to move forward or backward. The air conditioner 1 according to the disclosure, however, uses rotation of the guide unit 50 to open or close the outlet 14, thereby being slimmed down as compared to the air conditioner having the body tube structure.

Referring to FIG. 1, the plurality of holes 53 may be uniformly distributed on the first and second guides 51 and 52 of the guide unit 50. When the first and second guides 51 and 52 close the outlet 14, the air blown by the blower fan 31 may be discharged through the plurality of holes 53 formed on the cover parts 56 of the first and second guides 51 and 52.

When the air conditioner 1 is activated while the outlet 14 is closed by the guide unit 50, the wind having weak intensity and spreading in all directions may be discharged. The operation mode of the air conditioner 1 with the outlet 14 closed is defined as a no wind mode. In the no wind mode, indoor air conditioning may be performed slowly in general while preventing the user from being directly exposed to the wind.

Figure 6:
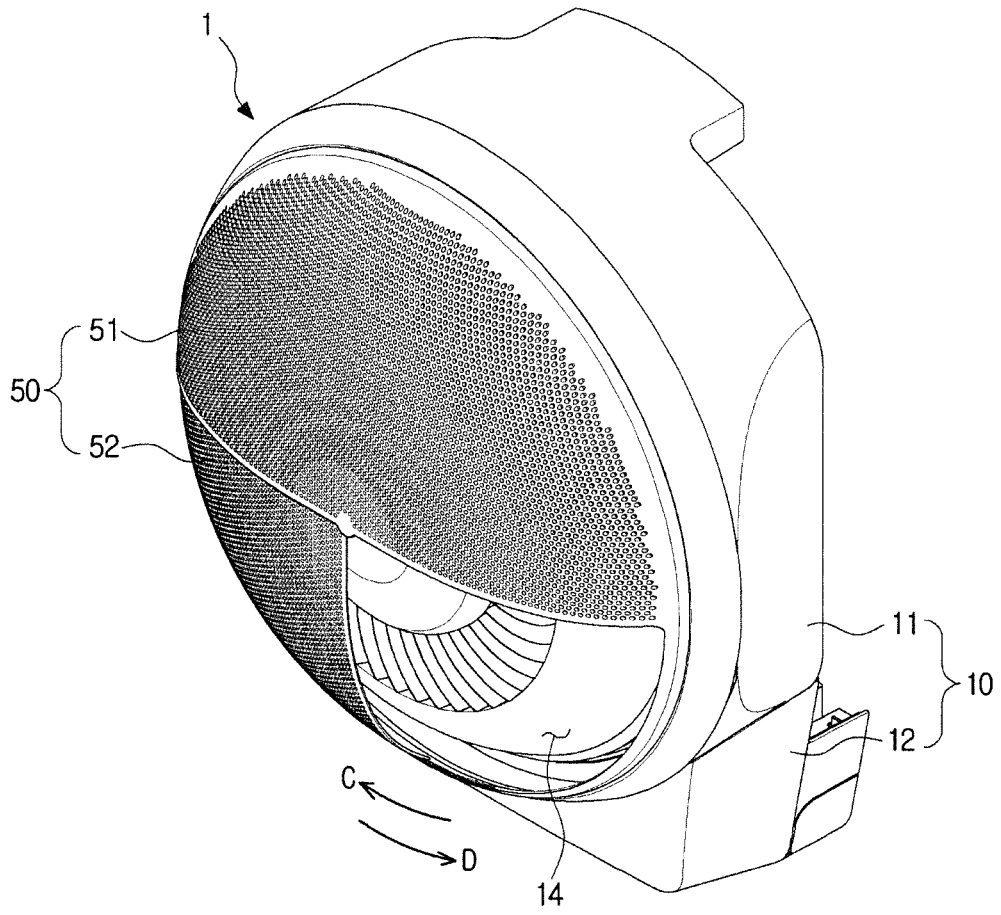
FIG. 6 shows a state in which part of an outlet is opened in an air conditioner, according to an embodiment of the disclosure.

FIG. 6 shows a state in which part of an outlet is opened in an air conditioner, according to an embodiment of the disclosure.

Referring to FIGS. 1 to 6, the second guide 52 of the guide unit 50 may open part of the outlet 14 while rotating in the first direction C and overlapping the first guide 51. Specifically, when the second guide 52 is rotated in the first direction C, the cover part 56 of the second guide 52 overlaps the cover part 56 of the first guide 51, making the opening 57 of the second guide 52 exposed to open part of the outlet 14.

Furthermore, when the second guide 52 is rotated by the motor 41 in the second direction D while the part of the outlet 14 is opened, the cover part 56 of the second guide 52 that has overlapped the cover part 56 of the first guide 51 becomes exposed and thus the opened part of the outlet 14 is closed.

Figure 7:
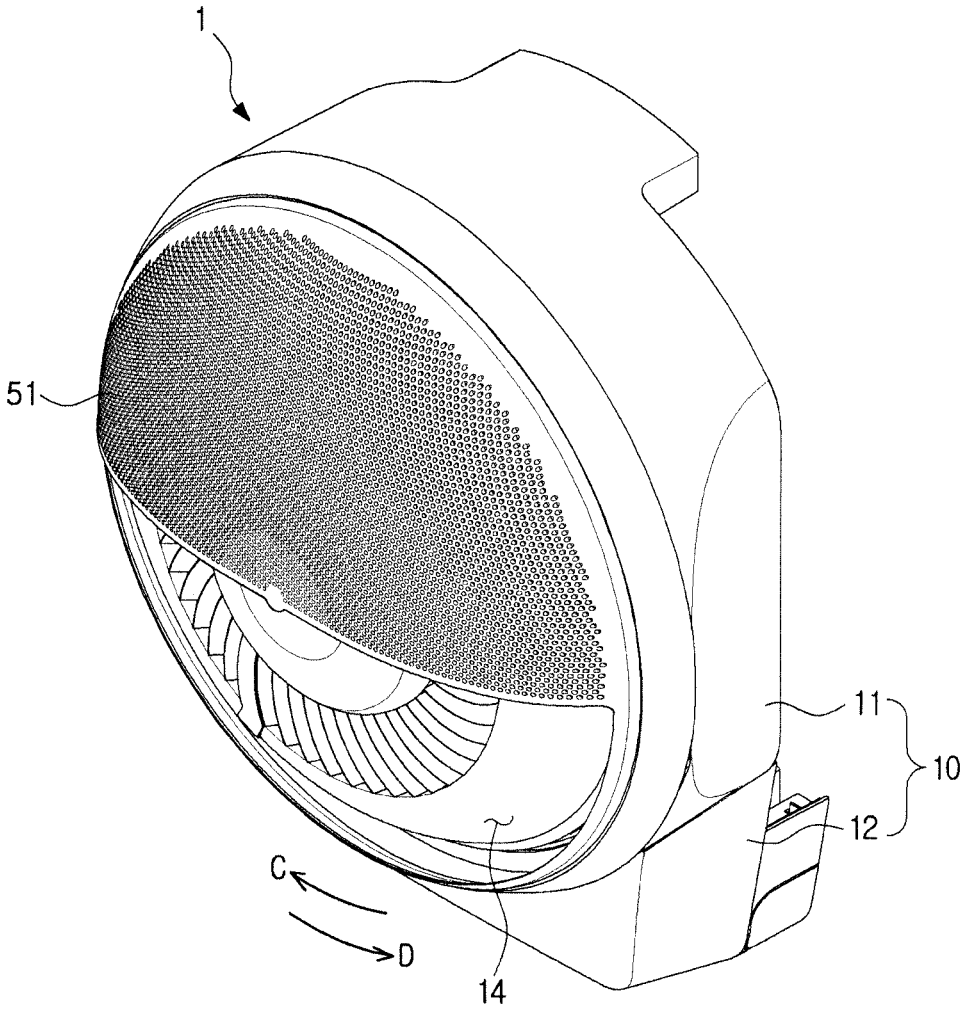
FIG. 7 shows a state of a direct-wind mode of an air conditioner, according to an embodiment of the disclosure.

FIG. 7 shows a state of a direct-wind mode of an air conditioner, according to an embodiment of the disclosure.

Referring to FIGS. 1 to 7, the second guide 52 of the guide unit 50 may open the lower half of the outlet 14 while rotating in the first direction C and fully overlapping the first guide 51. Specifically, when the second guide 52 is rotated in the first direction C, the cover part 56 of the second guide 52 fully overlaps the cover part 56 of the first guide 51, making the opening 57 of the second guide 52 fully exposed to open the lower half of the outlet 14.

When the air conditioner 1 is activated while the lower half of the outlet 14 is opened, the wind with strong intensity and directed forward and downward may be discharged. The air conditioner 1 according to the disclosure may be installed on the wall, and on the assumption that the air conditioner 1 is installed on the upper wall, an operation mode in which the lower half of the outlet 14 of the air conditioner 1 is opened is defined as a direct-wind mode. In the direct-wind mode, quick cooling or heating may be provided for the user by blowing strong wind directly to the user, and the high wind intensity and high air volume may enable quick indoor air conditioning.

When the second guide 52 of the guide unit 50 is rotated in the first direction and fully overlaps the first guide 51, an end of the second guide 52 comes into contact the stopper 60 formed on the rear side of the first guide 51.

Figure 8:
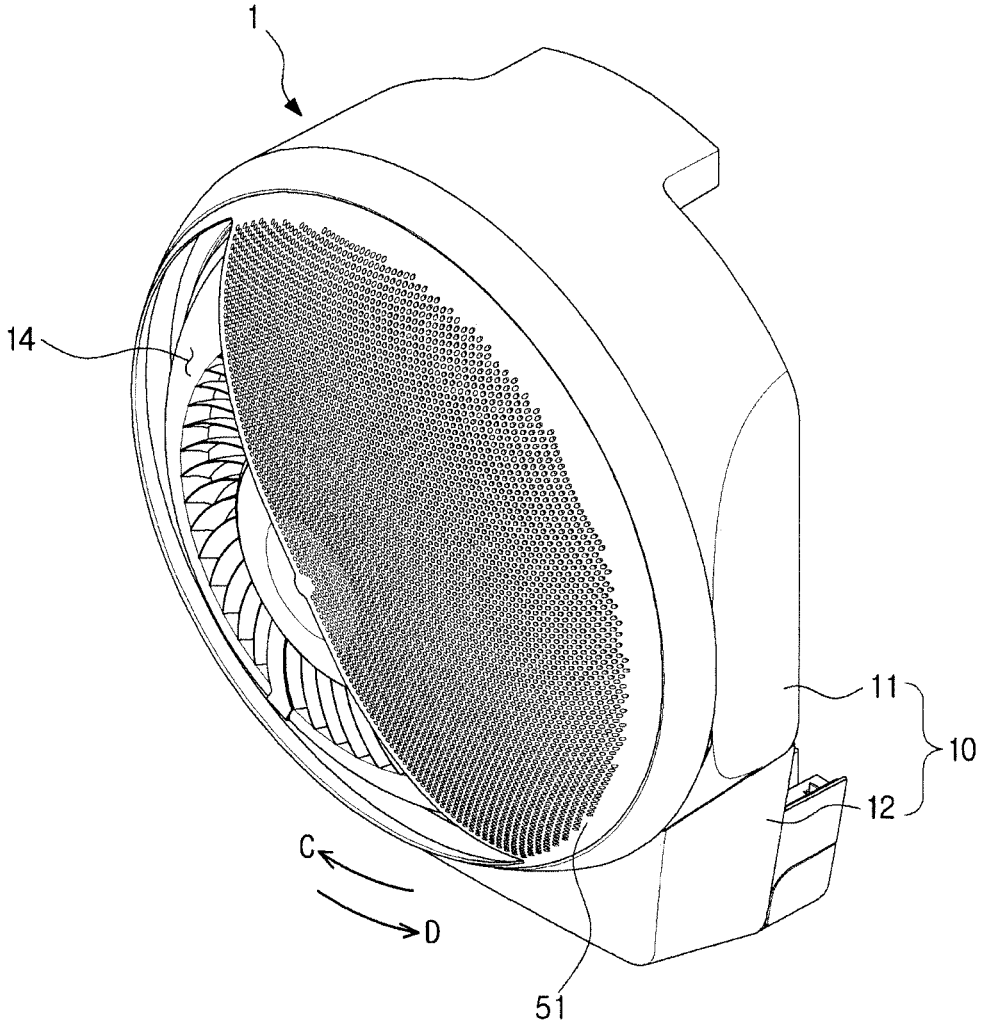
FIG. 8 shows a state in which both first and second guides are rotated in an air conditioner, according to an embodiment of the disclosure.

FIG. 8 shows a state in which both first and second guides are rotated in an air conditioner, according to an embodiment of the disclosure.

Referring to FIGS. 1 to 8, when the motor 41 rotates the second guide 52 of the guide unit 50 in the first direction C even after the second guide 52 fully overlaps the first guide 51 by being rotated in the first direction, the first and second guides 51 and 52 may be rotated together while an end of the second guide 52 is pushing the stopper 60 of the first guide 51.

When the guide unit 50 keeps rotating while the first and second guides 51 and 52 fully overlap each other to open the half of the outlet 14, the air conditioner 1 may variously discharge the air to the top, bottom, left and right at high wind velocity. The guide unit 50 may be set to open the left or right part of the outlet 14 so that left or right-directed wind may be discharged, or to be continuously rotated so that continuously varying flows of wind may be discharged.

Figure 9:
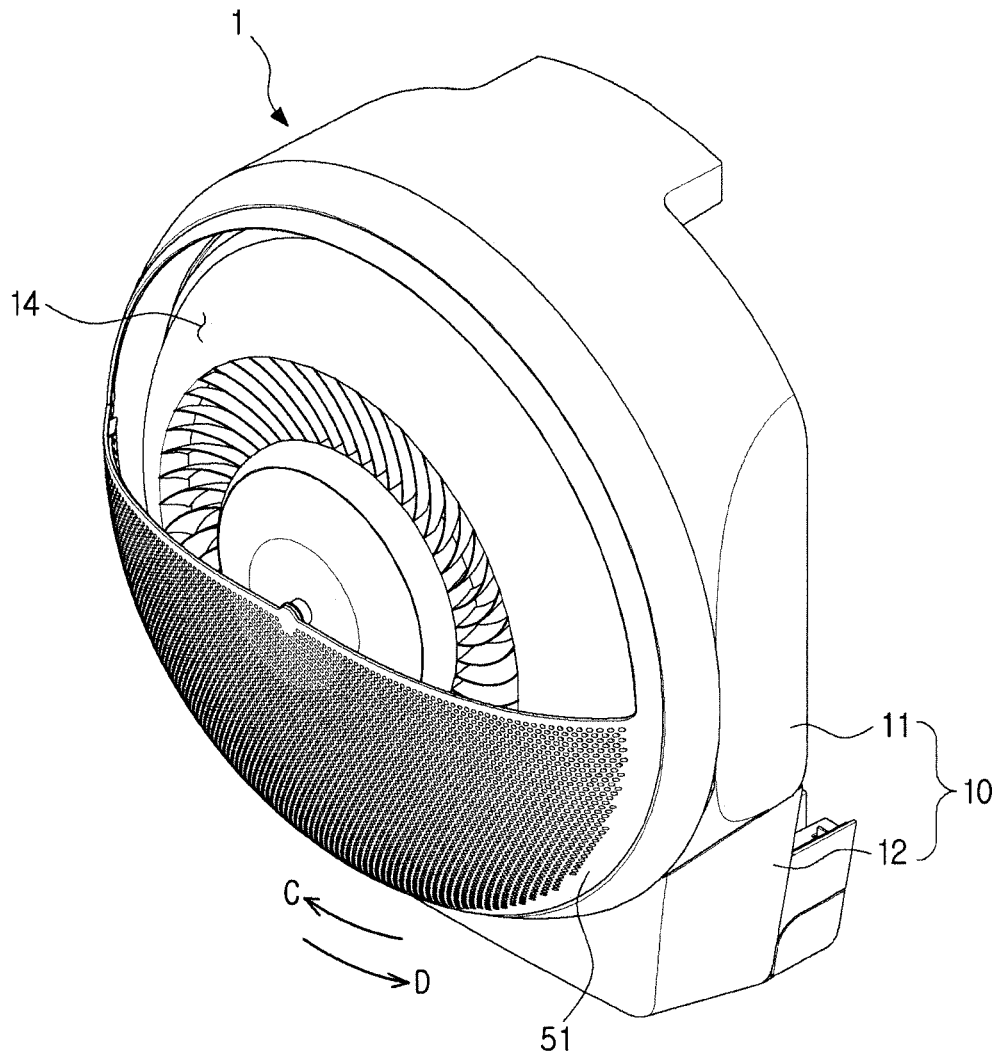
FIG. 9 shows a state of an indirect-wind mode of an air conditioner, according to an embodiment of the disclosure.

FIG. 9 shows a state of an indirect-wind mode of an air conditioner, according to an embodiment of the disclosure.

Referring to FIGS. 1 to 9, when the guide unit 50 keeps rotating while the first and second guides 51 and 52 fully overlap each other to open a half of the outlet 14, the upper half of the outlet 14 may be opened.

When the air conditioner 1 is activated while the upper half of the outlet 14 is opened, the wind with strong intensity and directed forward and upward may be discharged. The air conditioner 1 according to the disclosure may be installed on the wall, and on the assumption that the air conditioner 1 is installed on the upper wall, an operation mode in which the upper half of the outlet 14 of the air conditioner 1 is opened is defined as an indirect-wind mode. In the indirect-wind mode, cooling or heating may be performed by convection while preventing wind from being directly blown to the user, and the high wind intensity and high air volume may enable quick indoor air conditioning.

The plurality of holes 53 formed on the first guide 51 and the plurality of holes 53 formed on the second guide may be closed when the cover parts 56 of the first and second guides 51 and 52 fully overlap each other. Accordingly, no wind leaks through the part closed by the guide unit 50, thereby further improving the wind intensity of the air discharged through the opened part of the outlet 14.

As shown in FIGS. 1 and 6 to 9, the air conditioner 1 according to an embodiment may discharge air from inside the housing 10 through the plurality of holes 53 at low velocity while the guide unit 50 closes the outlet 14. Furthermore, the air conditioner 1 may control the flow of air discharged through the outlet 14 by opening or closing part of the outlet 14 by rotating the guide unit 50 and changing the position of the part of the outlet 14.

The air conditioner 50 according to an embodiment may have the guide unit 50 shaped like a dome, having a visual effect that the thickness of the air conditioner 1 is thin and increasing a discharging area in the no-wind mode. Moreover, in the direct or indirect-wind mode, the wind colliding with the guide unit 50 may be naturally turned, helping the wind blown out of the opened part of the outlet 14.

Although the guide unit 50 is shown to include the first and second guides 51 and 52, the idea of the disclosure is not limited thereto and the guide unit may be formed to have three or more guides. The plurality of guides may overlap each other by rotation to open part of the outlet, and in the case of having three or more guides, opening area of the outlet may be increased.

Figure 10:
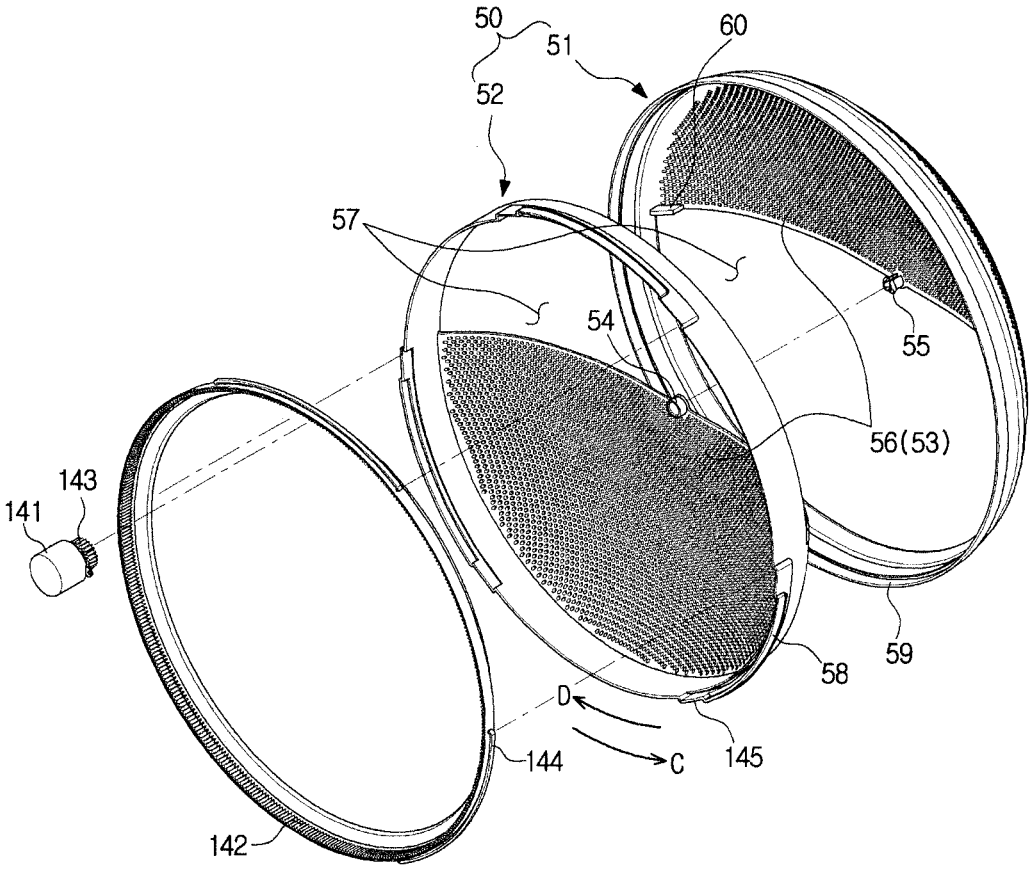
FIG. 10 is an exploded view of an air conditioner whose guide unit and motor are viewed from behind, according to another embodiment of the disclosure.

FIG. 10 is an exploded view of an air conditioner whose guide unit and motor are viewed from behind, according to another embodiment of the disclosure.

Referring to FIG. 10, a motor 141 for driving the guide unit 50 of the air conditioner 1 according to an embodiment may be arranged not in the center but near the edges of the guide unit 50. Specifically, a first gear 142 may have the form of a ring in a size that corresponds to the edges of the second guide 52 and may be coupled to the edges of the second guide 52, and a second gear 143 may be coupled to a driving shaft of the motor 141, so the second guide 52 may be rotated by the motor 141 in the first direction C or second direction D.

The first gear 142 may be formed to be an internal gear that has teeth arranged on the inner side of the gear and being in gear with the second gear 143 inside the gear. In the case that the first gear 142 is formed as the internal gear, the motor 141 may be arranged for the driving shaft to be parallel to the rotation shaft 54 of the second guide 52, and the first and second gears 142 and 143 rotates in the same direction.

A fixed projection 144 may be formed on the outside of the first gear 142 to be rotated in gear with the second guide 52, and a fixed groove 145 may be formed along the edges of the second guide 52 to receive the fixed projection 144 of the first guide 142.

Since the motor 141 is arranged near the edges of the guide unit 50, it is not arranged in tandem with the fan motor 34 that drives the blower fan 31 arranged in the center of the guide unit 50, thereby making the air conditioner 1 slimmed down.

The first and second guides 51 and 52 may be combined for the rotation shaft 55 of the first guide 51 to pass the rotation shaft 54 of the second guide 52, which is the cavity shaft. Furthermore, the guide projection 58 may be formed along the edges of the second guide 52 to be rotated in gear with the first guide 51, and the guide rail 59 may be formed along the edges of the first guide 51 to receive the guide projection 58 of the second guide 52.

The guide unit 50 may include the stopper 60 arranged for the second guide 52 to push and rotate with the first guide 51. The stopper 60 may be formed on the rear side of the first guide 51 to protrude toward the second guide 52. When the second guide 52 is rotated by the motor 141 in the first direction C and fully overlaps the first guide 51 or in the second direction D and completely closes the outlet 14, the first and second guides 51 and 52 may be rotated together in the first direction C or the second direction D.

Figure 11:
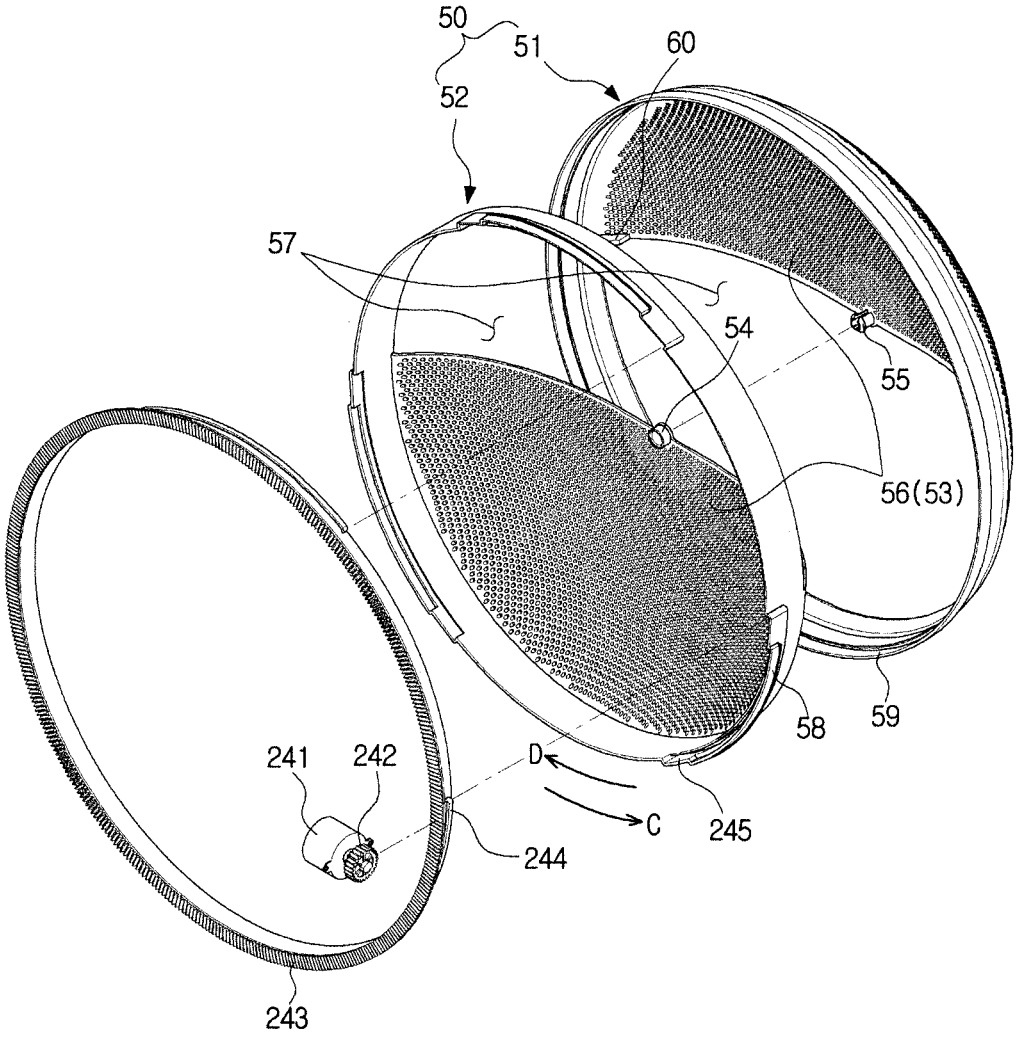
FIG. 11 is an exploded view of an air conditioner whose guide unit and motor are viewed from behind, according to another embodiment of the disclosure.

FIG. 11 is an exploded view of an air conditioner whose guide unit and motor are viewed from behind, according to another embodiment of the disclosure.

Referring to FIG. 11, a first gear 243 for rotating the second guide 52 of the guide unit 50 of the air conditioner 1 according to an embodiment may be formed as a crown gear that has an area where teeth are formed forms a flat plane. A second gear 242 in gear with the first gear 243 may correspond to a pinion, and the first gear 243 may correspond to a rack. With the first gear 243 formed as the crown gear, the motor 241 may be arranged to cross the rotation shaft line of the second guide 52.

A motor 241 for driving the guide unit 50 of the air conditioner 1 according to an embodiment may be arranged not in the center but near the edges of the guide unit 50. Specifically, a first gear 243 may have the form of a ring in a size that corresponds to the edges of the second guide 52 and may be coupled to the edges of the second guide 52 and a second gear 242 may be coupled to a driving shaft of the motor 241, so the second guide 52 may be rotated by the motor 241 in the first direction C or second direction D.

A fixed projection 244 may be formed on the outside of the first gear 243 to be rotated in gear with the second guide 52, and a fixed groove 245 may be formed along the edges of the second guide 52 to receive the fixed projection 244 of the first guide 243.

Since the motor 241 is arranged near the edges of the guide unit 50, it is not arranged in tandem with the fan motor 34 that drives the blower fan 31 arranged in the center of the guide unit 50, thereby making the air conditioner 1 slimmed down.

The first and second guides 51 and 52 may be combined for the rotation shaft 55 of the first guide 51 to pass the rotation shaft 54 of the second guide 52, which is the cavity shaft. Furthermore, the guide projection 58 may be formed along the edges of the second guide 52 to be rotated in gear with the first guide 51, and the guide rail 59 may be formed along the edges of the first guide 51 to receive the guide projection 58 of the second guide 52.

The guide unit 50 may include the stopper 60 arranged for the second guide 52 to push and rotate with the first guide 51. The stopper 60 may be formed on the rear side of the first guide 51 to protrude toward the second guide 52. When the second guide 52 is rotated by the motor 241 in the first direction C and fully overlaps the first guide 51 or in the second direction D and completely closes the outlet 14, the first and second guides 51 and 52 may be rotated together in the first direction C or the second direction D.

Although not shown, the first gear for driving the guide unit 50 of the air conditioner according to an embodiment may be coupled to the rotation shaft 54 of the second guide 52. For example, as shown in FIG. 4, the guide driver 40 is arranged in the center of the guide unit 50, and the first gear may be formed as a crown gear that has an area where teeth are formed forms a flat plane. Furthermore, the motor may be arranged to cross the rotation shaft line of the second guide 52.

Even in this case, the first and second gears may make the motor of the guide driver 40 and the fan motor 34 for driving the blower fan 31 arranged back and forth not in a straight line but obliquely. Accordingly, even when the guide driver 40 is arranged at the center of the guide unit 50 so that the guide driver 40 and the fan motor 34 are arranged in tandem in the same line, the motor at the center of the guide unit 50 and the fan motor 34 are arranged obliquely, thereby allowing the air conditioner 1 to be slimmed down.

Furthermore, although not shown, the guide unit of the air conditioner according to an embodiment may include a plurality of guides and a plurality of motors to respectively rotate the plurality of guides. For example, the air conditioner according to an embodiment may include a first motor to rotate the first guide 51 and a second motor to rotate the second guide 52.

The first motor may be coupled to the first guide 51 by the first and second gears. The first gear may have the form of a ring in a size that corresponds to the edges of the first guide and may be coupled to the edges of the first guide, and the second gear may be coupled to a driving shaft of the first motor, so the first guide 51 may be rotated by the first motor in the first direction C or second direction D.

A fixed projection may be formed on the outside of the first gear to be rotated in gear with the first guide 51, and a fixed groove may be formed along the edges of the first guide 51 to receive the fixed projection of the first guide.

The second motor may be coupled to the second guide by third and fourth gears. The third gear may be coupled to the rotation shaft 54 of the second guide 52, and the fourth gear may be coupled to a driving shaft of the second motor, so the second guide 52 may be rotated by the second motor in the first direction C or second direction D.

Since the motor 1 is arranged near the edges of the guide unit 50, it may not be arranged in tandem with the fan motor 34 that drives the blower fan 31 arranged in the center of the guide unit 50. Furthermore, even when the second motor is arranged in the center of the guide unit 50, the second motor and the fan motor 34 for driving the blower fan 31 with the third and fourth gears are arranged back and forth not in the same straight line but obliquely. Accordingly, a slim air conditioner 1 may be implemented.

The first and second guides 51 and 52 may be combined for the rotation shaft 55 of the first guide 51 to pass the rotation shaft 54 of the second guide 52, which is the cavity shaft. Furthermore, the guide projection 58 may be formed along the edges of the second guide 52 to be rotated in gear with the first guide 51, and the guide rail 59 may be formed along the edges of the first guide 51 to receive the guide projection 58 of the second guide 52.

Since the first guide 51 may be rotated by the first motor in the first direction C or in the second direction D and the second guide 52 may be rotated by the second motor in the first direction C or in the second direction D, the air conditioner may selectively open part of the outlet 14 while the first and second guides 51 and 52 are overlapping each other by rotation of at least one of the first and second guides 51 and 52.

The first and second motors are arranged to rotate the first and second guides 51 and 52, respectively, so that there is no need to rotate even the first guide 51 with a single motor that rotates the second guide 52. Specifically, the first guide 51 does not require a structure such as a stopper, and may be rotated by the first motor even without fully overlapping the second guide 52 or completely closing the outlet 14.

When the first and second guides 51 and 52 may be controlled by the respective motors, mode switching among modes, such as no wind mode, direct-wind mode, left-wind mode, right-wind mode, and indirect-wind mode.

The air conditioner 1 may include the sensor 61 for setting up and controlling a reference position for the first and second guides 51 and 52 of the guide unit 50 to return to the reference position even in the case of controlling the first and second guides 51 and 52 with the respective motors.

The first guide 51 may include the sensing part 62 on the rear side, and the sensor 61 may be arranged to detect the sensing part 62 when the first guide 51 is at the reference position. The sending part 62 may be arranged to be hidden when the first guide 51 is rotated in the second direction D or the second guide 52 is rotated in the first direction C, and to be exposed when the first guide 51 is rotated in the first direction C or the second guide 52 is rotated in the second direction D to fully close the outlet 14. The sensing part 62 may be formed of e.g., a magnet, and the sensor 61 may be formed with e.g., a hall sensor.

Figure 12:
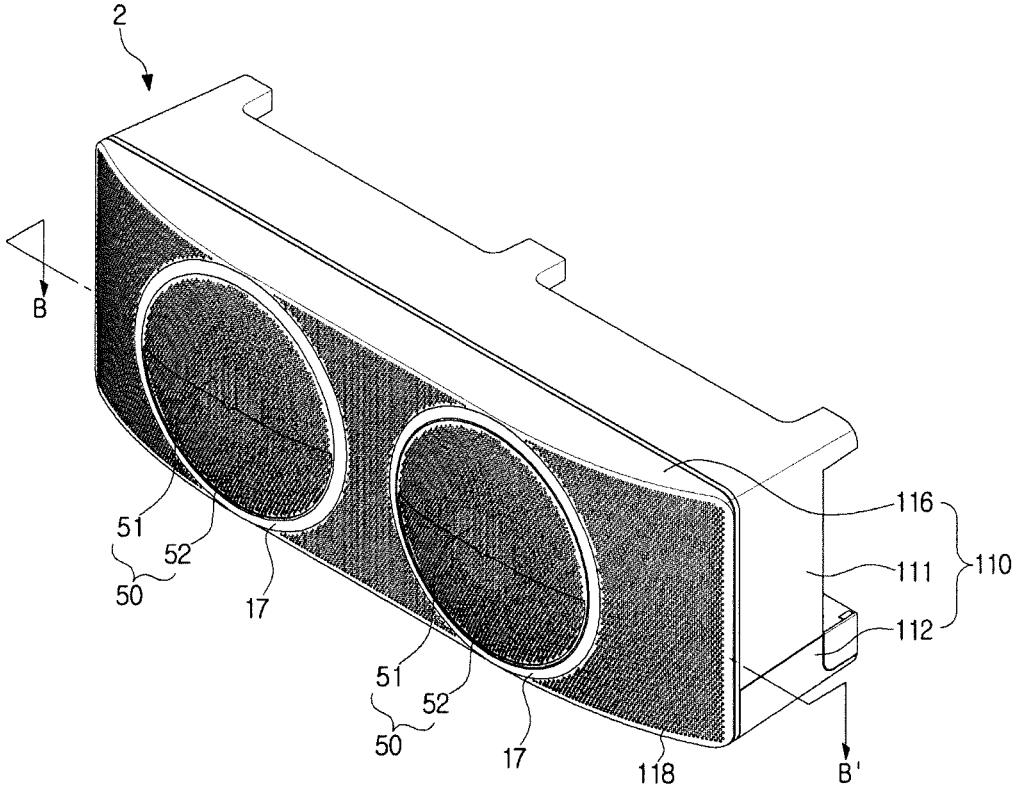
FIG. 12 is a perspective view of an air conditioner, according to another embodiment of the disclosure.
Figure 13:
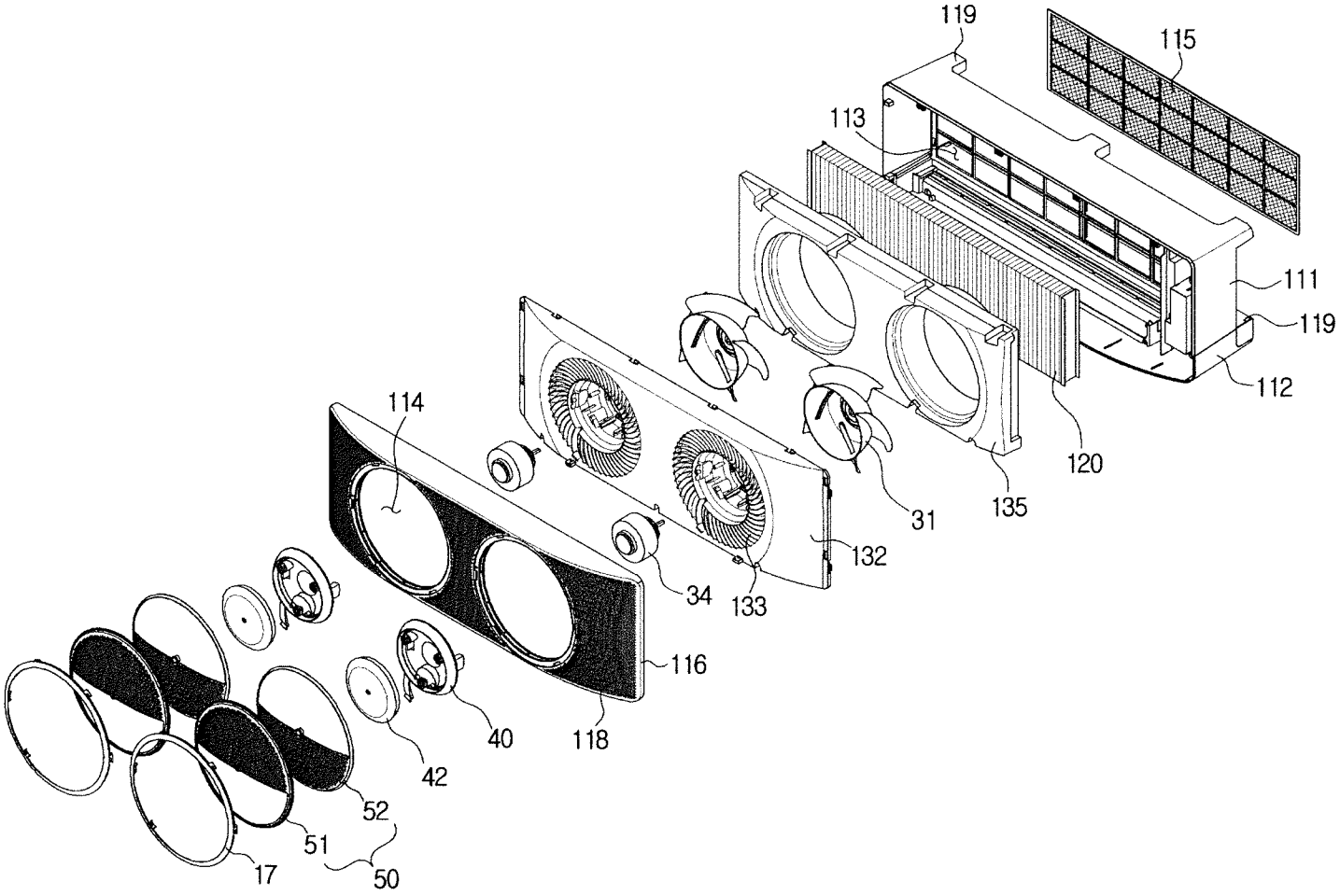
FIG. 13 is an exploded view of an air conditioner, according to another embodiment of the disclosure.
Figure 14:
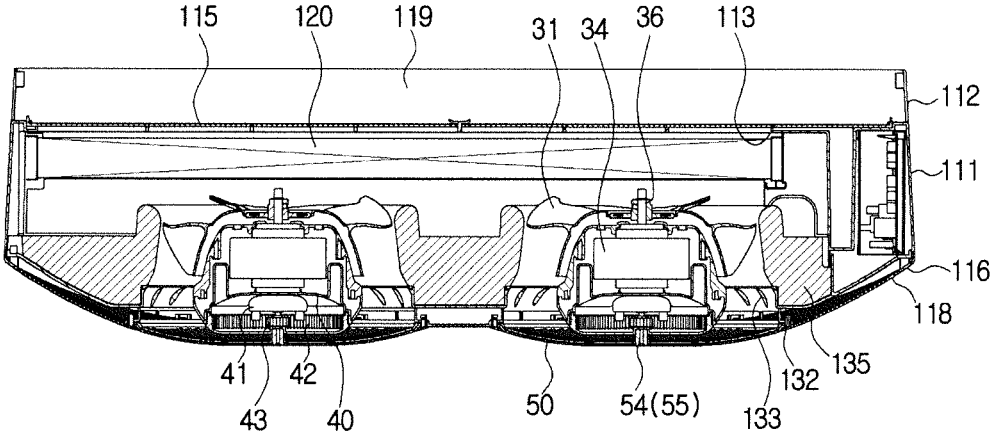
FIG. 14 is a cross-sectional view of B-B' of FIG. 12.

FIG. 12 is a perspective view of an air conditioner, according to another embodiment of the disclosure, FIG. 13 is an exploded view of an air conditioner, according to another embodiment of the disclosure, and FIG. 14 is a cross-sectional view of B-B' of FIG. 12.

An air conditioner 2 may include a housing 110 having an inlet 113 and an outlet 114, a heat exchanger 120 arranged inside the housing 110 for exchanging heat with air moved into the housing 110, and a blower fan 31 for sucking air into the housing 110 and circulating the air toward the outlet 114.

The housing 110 may include a main housing body 111 shaped almost like a rectangular cube, a front cover 116 having a circular outlet 114, and a bottom cover 112 that may be opened downward.

The air conditioner 2 may be arranged to be fixed to the wall. Specifically, the main housing body 111 may be arranged to be fixed to the wall. The main housing body 111 may include legs 119 arranged for the inlet 113, which is located on the rear side of the main housing body 111, to be separated from the wall, such that air may be sucked in through the inlet 113 while the air conditioner 2 is fixed to the wall.

The bottom cover 112 may be provided to be opened or closed vertically after the main housing body 111 is fixed to the wall, making it easy to connect pipes or power lines in the installation process of the air conditioner 2.

The air conditioner 2 may include a guide unit 50 to open or close the outlet 114. Furthermore, the air conditioner 2 may include a ring-shaped finishing member 17 for decoration of the edges of the guide unit 50. Specifically, the guide unit 50 may be arranged on the front of the housing 110 to selectively open or close a portion of the outlet 114 by rotation. As the guide unit 50 selectively opens or closes a portion of the outlet 114, it may control airflow such as the direction or air volume of air discharged through the outlet 114. Furthermore, the guide unit 50 may include a plurality of holes 53 to discharge air from inside the housing 110 when the outlet 114 is closed.

The housing 110 of the air conditioner 2 may include a plurality of outlets 114. Specifically, the plurality of outlets 114 may be formed on the front cover 116, and a plurality of holes 118 may be formed around the outlets 114 to discharge air. The air conditioner 2 may include a plurality of blower fans 31 corresponding to the plurality of outlets 114, and a plurality of guide units 50.

The guide unit 50 may include a plurality of guides shaped like arcs, which cover the circular outlet 114. Specifically, the guide unit 50 may be shaped like a dome, including the first guide 51 covering a portion of the outlet 114 and the second guide 52 covering the other portion of the outlet 114. A portion of the outlet 114 may be opened by rotation of at least one of the first and second guides 51 and 52.

The first and second guides 51 and 52 may include rounded edges to match the circular outlet, and include the cover parts 56 that cover portions of the outlet 114 and openings 57 that may open part of the outlet 114. The cover parts 56 may include the plurality of holes 53 to discharge air from inside the housing 110 when the guide unit 50 closes the outlet 114.

Although not shown, the guide unit may be provided to include a plurality of guides formed in other various shapes that are rotational, besides the dome shape.

The blower fan 31 may be an axial-flow fan or a mixed-flow fan. The blower fan 31 may be arranged for a rotation shaft 36 to be perpendicular to the outlet 114 in order to circulate air directly toward the outlet 14. Specifically, the blower fan 31 may be arranged for the rotation shaft 36 to be in parallel with rotation shafts 54 and 55 of the guide unit 50 that covers the outlet 114.

The air conditioner 2 may include a blower grill 132 arranged in front of the blower fan 31. The blower grill 132 may be arranged in a discharging direction of the blower fan 31 to guide the flow of air. Furthermore, the blower grill 132 may be arranged between the blower fan 31 and the outlet 114 for minimizing the influence of outside conditions of the housing 110 on the blower fan 31.

The blower grill 132 may include a plurality of wings 133. The plurality of wings 133 may control the direction or the volume of the air blown from the blower fan 31 to the outlet 114 by controlling the number, shape, and/or position angle of the wings 33. There may be a plurality of wings 133 provided each to correspond to each of the outlets 114 in the case that there are a plurality of outlets 114.

The blower grill 132 may be provided for the guide driver 40 and the fan motor 34 to be arranged at the center of the plurality of wings 133. The guide drive 40 and the fan motor 34 may be arranged to be in tandem in the same line. With this structure, the plurality of wings 133 of the blower grill 132 may be arranged in front of the fan wings of the blower fan 31.

The air conditioner 2 may include a bell mouth 135 formed to have a circular shape that encloses the blower fan 31 to guide the flow of air flowing to the blower fan 31. In other words, the bell mouth 135 guides the air sucked in through the inlet 113 and moved into the housing 110 to flow to the blower fan 31.

The blower fan 31 may be arranged in front of the inlet 113 placed on the rear side of the main housing body 111, and the heat exchanger 120 may be arranged between the blower fan 31 and the inlet 113. The heat exchanger 120 may absorb heat from the air brought in through the inlet 113 or transfer heat to the air brought in through the inlet 113.

Although not shown, the heat exchanger 120 may be arranged between the blower fan 31 and the outlet 114. When the heat exchanger 120 is arranged before the blower fan 31, it may help the air discharged through the outlet 114 have a uniform distribution of temperature.

A filter 115 may be attached to the outer side of the inlet 113 of the housing 110. The filter 115 may filter out foreign materials such as dust contained in the outside air sucked in through the inlet 113. Furthermore, although not shown, the air conditioner 2 may further include an extra filter arranged inside the housing 110 to adsorb and filter out foreign materials such as dust and scent molecules contained in the air.

The guide driver 40 may include the motor 41 provided to rotationally drive at least one of the first and second guides 51 and 52. The guide driver 40 may also include the first gear 42 coupled to at least one of the first and second guides 51 and 52, and the second gear 43 coupled to the motor 41. At least one of the first and second guides 51 and 52 may be coupled to the motor 41 by the first and second gears 42 and 43.

A driving mechanism of the motor 41, first gear 42, second gear 43, first guide 51, and the second guide 52 is shown in FIGS. 1 to 4, and is the same as what is described above. Furthermore, the motor, the first gear, the second gear, the first guide, and the second guide may be arranged as shown in FIGS. 10 and 11 and described above.

In the case that the air conditioner 2 includes a plurality of outlets 114 and a plurality of guide units 50, guide drivers 40 may be provided to drive the respective guide units 50 and configured to control the plurality of guide unit 50 separately. For example, each guide unit 50 may be separately rotated in the first direction C or second direction D.

Furthermore, as shown in FIG. 5, the air conditioner 2 may include the sensor 61 that sets up and controls a reference position for the first and second guides 51 and 52 to return to the reference position after the second guide 52 of the guide unit 50 is rotated in the second direction D and completely closes the outlet 114.

The first guide 51 may include the sensing part 62 on the rear side, and the sensor 61 may be arranged to detect the sensing part 62 when the first guide 51 is at the reference position. The sending part 62 may be arranged to be hidden when the first guide 51 is rotated in the second direction D or the second guide 52 is rotated in the first direction C, and to be exposed when the first guide 51 is rotated in the first direction C or the second guide 52 is rotated in the second direction D to fully close the outlet 114. The sensing part 62 may be formed of e.g., a magnet, and the sensor 61 may be formed with e.g., a hall sensor.

Although not shown, the guide unit of the air conditioner according to an embodiment may include a plurality of guides and a plurality of motors to respectively rotate the plurality of guides. For example, the air conditioner according to an embodiment may include a first motor to rotate the first guide 51 and a second motor to rotate the second guide 52. A mechanism to drive the first and second guides 51 and 52 using the respective motors is the same as what is described above.

Referring to FIG. 12, the plurality of holes 53 may be uniformly distributed on the first and second guides 51 and 52 of the guide unit 50, and the plurality of holes 118 may be provided to be uniformly distributed around the outlet 114 of the front cover 116. When the first and second guides 51 and 52 close the outlet 114, the air blown by the blower fan 31 may be discharged through the plurality of holes 53 formed on the cover parts 56 of the first and second guides 51 and 52 and the plurality of holes 118 formed on the front cover 116.

When the air conditioner 2 is activated while the outlet 114 is closed by the guide unit 50, the wind having weak intensity and spreading in all directions may be discharged. The operation mode of the air conditioner 2 with the outlet 114 closed is defined as a no wind mode. When the air conditioner 2 operates in the no wind mode, air is discharged from the entire face of the front cover 116 with the outlet 114 formed thereon, so the no wind mode may make it possible to perform quick air conditioning in the room only with air discharged at low velocity while preventing the air from being directly blown to the user.

Figure 15:
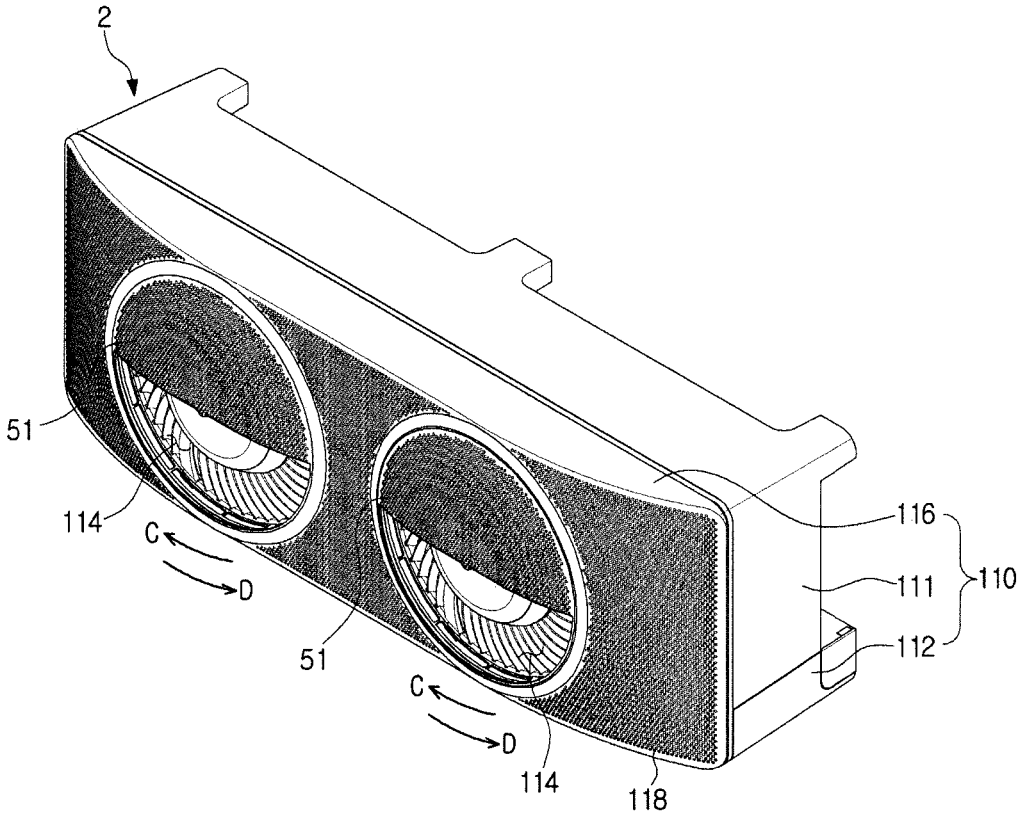
FIG. 15 shows a state of a direct-wind mode of an air conditioner, according to another embodiment of the disclosure.

FIG. 15 shows a state of a direct-wind mode of an air conditioner, according to another embodiment of the disclosure.

Referring to FIGS. 6 to 9 and 15, the second guide 52 of the guide unit 50 may open part of the outlet 114 while rotating in the first direction C and overlapping the first guide 51. Specifically, when the second guide 52 is rotated in the first direction C, the cover part 56 of the second guide 52 overlaps the cover part 56 of the first guide 51, making the opening 57 of the second guide 52 exposed and thus opening part of the outlet 114.

Furthermore, when the second guide 52 is rotated by the motor 41 in the second direction D while the part of the outlet 114 is opened, the cover part 56 of the second guide 52 that has overlapped the cover part 56 of the first guide 51 becomes exposed and thus the part of the outlet 114 is closed.

The second guide 52 of the guide unit 50 may open the lower half of the outlet 114 while rotating in the first direction C and fully overlapping the first guide 51. Specifically, when the second guide 52 is rotated in the first direction C, the cover part 56 of the second guide 52 fully overlaps the cover part 56 of the first guide 51, making the opening 57 of the second guide 52 fully exposed and thus opening the lower half of the outlet 114.

When the air conditioner 2 is activated while the lower half of the outlet 114 is opened, the wind with strong intensity and directed forward and downward may be discharged. The air conditioner 2 according to the disclosure may be installed on the wall, and on the assumption that the air conditioner 2 is installed on the upper wall, an operation mode in which the lower half of the outlet 114 of the air conditioner 1 is opened is defined as a direct-wind mode. In the direct-wind mode, quick cooling or heating may be provided for the user by blowing strong wind directly to the user, and the high wind intensity and high air volume may enable quick indoor air conditioning.

Besides the no wind mode and direct-wind mode, when the guide unit 50 keeps rotating while the first and second guides 51 and 52 fully overlap each other to open an half of the outlet 114 as shown in FIG. 8, the air conditioner 2 may variously discharge the air to the top, bottom, left and right at high wind velocity. The guide unit 50 may be set to open the left or right part of the outlet 114 so that left or right-directed wind may be discharged, or to be continuously rotated so that continuously varying flows of wind may be discharged.

Furthermore, as shown in FIG. 9, the air conditioner 2 may discharge the wind with strong intensity and directed forward and upward. The air conditioner 2 according to the disclosure may be installed on the wall, and on the assumption that the air conditioner 2 is installed on the upper wall, an operation mode in which the upper half of the outlet 114 of the air conditioner 1 is opened is defined as an indirect-wind mode. In the indirect-wind mode, cooling or heating may be performed by convection while preventing wind from being directly blown to the user, and the high wind intensity and high air volume may enable quick indoor air conditioning.

The plurality of holes 53 formed on the first guide 51 and the plurality of holes 53 formed on the second guide may be closed when the cover parts 56 of the first and second guides 51 and 52 fully overlap each other. Accordingly, no wind leaks through the part closed by the guide unit 50, thereby further improving the wind intensity of the air discharged through the opened part of the outlet 114.

When the air conditioner 2 according to an embodiment includes a plurality of outlets 114, it may control the guide unit 50 separately to open or close each of the outlets 114, thereby enabling itself to operate in different modes.

The air conditioner 2 according to an embodiment may discharge air from inside the housing 110 at low velocity through the plurality of holes 53 formed on the guide unit 50 and the plurality of holes 118 formed on the front cover 116 when the guide unit 50 closes the outlet 114. Furthermore, the air conditioner 2 may control the flow of air discharged through the outlet 114 by opening or closing part of the outlet 114 by rotating the guide unit 50 and changing the position of the part of the outlet 114.

Although the guide unit 50 is shown to include the first and second guides 51 and 52, the idea of the disclosure is not limited thereto and the guide unit may be formed to have three or more guides. The plurality of guides may overlap each other by rotation to open part of the outlet, and in the case of having three or more guides, opening area of the outlet may be increased.

The scope of the disclosure is not limited to the aforementioned embodiments. It will be understood by those skilled in the art that various changes in form and details may be made therein without departing from the spirit and scope of the disclosure as defined by the appended claims and their equivalents.

The invention claimed is:

1. An air conditioner comprising:

a housing having an outlet;

a heat exchanger arranged inside the housing;

a guide unit configured to control airflow discharged through the outlet by selectively opening or closing part of the outlet by rotation, the guide unit having a convex shape toward a direction in which air is discharged from the outlet and including a first rotatable arc-shaped guide including a first opening and a first cover part having holes, and a second rotatable arc-shaped guide including a second opening and a second cover part having holes; and a blower fan configured to suck air into the housing to move the air toward the outlet, wherein when the second rotatable arc-shaped guide is rotated to fully overlap with the first rotatable arc-shaped guide in a first direction, a position of an open portion of the outlet continuously rotates such that a wind direction of the outlet is continuously changed.

2. The air conditioner of claim 1, wherein the first rotatable arc-shaped guide covers part of the outlet and the second rotatable arc-shaped guide covers the other part of the outlet, wherein the second rotatable arc-shaped guide opens the other part of the outlet while overlapping the first rotatable arc-shaped guide by being rotated in the first direction, and wherein when the other part of the outlet is opened, the second rotatable arc-shaped guide closes the other part of the outlet by being rotated in a second direction.

3. The air conditioner of claim 2, wherein when the second rotatable arc-shaped guide is rotated in the first direction to fully overlap the first rotatable arc-shaped guide or in the second direction to fully close the outlet, the first and second rotatable arc-shaped guides are rotated together in the first or second direction.

4. The air conditioner of claim 2, further comprising:

a motor provided to rotate the second rotatable arc-shaped guide in the first or second direction.

5. The air conditioner of claim 4, further comprising:

a first gear coupled to the second rotatable arc-shaped guide, and a second gear coupled to the motor, wherein the second rotatable arc-shaped guide is coupled to the motor by the first and second gears.

6. The air conditioner of claim 5, wherein the first gear is formed as an internal gear, and wherein the motor is arranged to have a driving shaft arranged in parallel with a rotation shaft of the second rotatable arc-shaped guide.

7. The air conditioner of claim 5, wherein the first gear is formed as a crown gear, and wherein the motor is arranged to have a driving shaft line cross a rotation shaft line of the second rotatable arc-shaped guide.

8. The air conditioner of claim 5, wherein the first gear is coupled to a rotation shaft of the second rotatable arc-shaped guide, and wherein the motor is arranged in a center part of the second rotatable arc-shaped guide.

9. The air conditioner of claim 5, wherein the first gear is coupled to an edge of the second rotatable arc-shaped guide, and wherein the motor is arranged near the edge of the second rotatable arc-shaped guide.

10. The air conditioner of claim 1, wherein the first cover part of the first rotatable arc-shaped guide covers part of the outlet and the second cover part of the second rotatable arc-shaped guide covers the other part of the outlet, wherein the air conditioner further comprises a first motor configured to rotate the first rotatable arc-shaped guide and a second motor configured to rotate the second rotatable arc-shaped guide, and wherein part of the outlet is selectively opened while the first and second cover parts of the first and second rotatable arc-shaped guides overlap each other by rotation of at least one of the first and second rotatable arc-shaped guides.

11. The air conditioner of claim 1, wherein the outlet has a circular form, and wherein the guide unit has a domed form.

12. The air conditioner of claim 1, wherein the housing comprises a main housing body and a bottom cover capable of being opened downward.

13. The air conditioner of claim 1, wherein the housing comprises an inlet provided on a rear side, and a leg provided for the inlet to be separated from an installation plane.

14. The air conditioner of claim 1, further comprising: a sensor configured to set up and control a reference position for the guide unit.

15. The air conditioner of claim 1, wherein the holes in the first and second cover parts of the first and second rotatable arc-shaped guides discharge air from inside the housing when the outlet is closed.

16. An air conditioner comprising:

a housing having an outlet;

a heat exchanger arranged inside the housing;

a blower fan configured to suck air into the housing and move air toward the outlet; and a guide unit configured to open or close part of the outlet by being rotated, control airflow discharged through the outlet by changing a position of an opened part of the outlet, the guide unit including a first rotatable arc-shaped guide having a first opening and having a first cover part with holes and a second rotatable arc-shaped guide having a second opening and having a second cover part with holes, the holes in the first and second cover parts of the first and second rotatable arc-shaped guides being configured to discharge air from inside the housing when the outlet is closed, wherein when the second rotatable arc-shaped guide is rotated to fully overlap with the first rotatable arc-shaped guide in a first direction, a position of an open portion of the outlet continuously rotates such that a wind direction of the outlet is continuously changed.

17. The air conditioner of claim 16, wherein the outlet has a circular form, and wherein the first and second cover parts of the first and second rotatable arc-shaped guides open part of the outlet while overlapping each other by rotation.

18. An air conditioner comprising:

a housing including an outlet and a plurality of holes formed around the outlet to discharge air;

a heat exchanger arranged inside the housing;

a blower fan configured to suck air into the housing and move air toward the outlet; and a guide unit configured to control airflow discharged through the outlet by selectively opening or closing part of the outlet, the guide unit having a convex shape toward a direction in which air is discharged from the outlet and including a first rotatable arc-shaped guide including a first opening and a first cover part having holes and a second rotatable arc-shaped guide including a second opening and a second cover part having holes, wherein when the second rotatable arc-shaped guide is rotated to fully overlap with the first rotatable arc-shaped guide in a first direction, a position of an open portion of the outlet continuously rotates such that a wind direction of the outlet is continuously changed.

19. The air conditioner of claim 18, wherein the housing comprises a plurality of outlets, and wherein the blower fan comprises plural blower fans and the guide unit comprises plural guide units to correspond to the plurality of outlets.

20. The air conditioner of claim 18, wherein the first and second openings of the first and second rotatable arc-shaped guides are configured to open part of the outlet while overlapping each other by rotation.

* * * * *